US010611587B2

(12) United States Patent
Kato et al.

(10) Patent No.: US 10,611,587 B2
(45) Date of Patent: Apr. 7, 2020

(54) SHEET FEEDING APPARATUS AND IMAGE FORMING APPARATUS

(71) Applicant: CANON KABUSHIKI KAISHA, Tokyo (JP)

(72) Inventors: Hiroki Kato, Gotemba (JP); Hidehiro Ushiozu, Mishima (JP); Akira Matsushima, Susono (JP); Satoshi Koga, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/115,743

(22) Filed: Aug. 29, 2018

(65) Prior Publication Data

US 2019/0077621 A1 Mar. 14, 2019

(30) Foreign Application Priority Data

Sep. 14, 2017 (JP) ..... 2017-177086

(51) Int. Cl.
*B65H 3/06* (2006.01)
*B65H 1/26* (2006.01)
*B65H 3/52* (2006.01)

(52) U.S. Cl.
CPC ..... *B65H 3/0684* (2013.01); *B65H 1/266* (2013.01); *B65H 3/0676* (2013.01);
(Continued)

(58) Field of Classification Search
CPC ..... B65H 3/0684; B65H 1/266; B65H 3/0676
(Continued)

(56) References Cited

U.S. PATENT DOCUMENTS 5,451,043 A * 9/1995 Arai ..... B65H 3/5215 271/121
7,011,306 B2 3/2006 Kato et al.
(Continued)

FOREIGN PATENT DOCUMENTS

EP 3 124 411 A1 2/2017
JP 2000-296931 A 10/2000
(Continued)

OTHER PUBLICATIONS

European Search Report dated Feb. 14, 2019, in related European Patent Application No. 18191374.0.

*Primary Examiner* — Thomas A Morrison
(74) *Attorney, Agent, or Firm* — Venable LLP

(57) ABSTRACT

A sheet feeding apparatus is provided with a disengaging mechanism configured to disengage a conveyance member and a separating member to be apart from each other. Either one of the conveyance member and the separating member is provided in a unit, which is attached to an apparatus body and is configured to be detached from the apparatus body toward a downstream side in the sheet conveyance direction, while the other provided in the apparatus body. A restriction portion is configured to restrict the unit from being attached to and detached from the apparatus body in a state where the conveyance member and the separating member are in contact with each other and to permit the unit to be attached to and detached from the apparatus body in a state where the conveyance member and the separating member are disengaged by the disengaging mechanism.

17 Claims, 19 Drawing Sheets

(52) U.S. Cl.
CPC ..... *B65H 3/5215* (2013.01); *B65H 3/5261* (2013.01); *B65H 2402/31* (2013.01); *B65H 2402/32* (2013.01); *B65H 2601/324* (2013.01)

(58) Field of Classification Search
USPC ..... 271/114, 117, 118, 162
See application file for complete search history.

(56) References Cited

U.S. PATENT DOCUMENTS

| | | | | |
|---|---|---|---|---|
| 7,913,996 | B2 * | 3/2011 | Nishikata | B65H 3/0638 271/145 |
| 7,971,868 | B2 | 7/2011 | Matsushima et al. | |
| 8,523,173 | B2 * | 9/2013 | Hayayumi | B65H 1/266 271/117 |
| 8,695,965 | B2 * | 4/2014 | Shin | B65H 1/266 271/121 |
| 8,781,388 | B2 * | 7/2014 | Yamaguchi | B65H 3/0607 271/121 |
| 9,840,382 | B2 | 12/2017 | Okazaki et al. | |
| 9,880,505 | B2 | 1/2018 | Matsumoto | |
| 10,040,652 | B2 | 8/2018 | Fujita | |
| 2012/0126475 | A1 * | 5/2012 | Shin | B65H 1/266 271/117 |
| 2014/0252712 | A1 | 9/2014 | Masubuchi et al. | |
| 2016/0289017 | A1 | 10/2016 | Yoshida et al. | |
| 2016/0318723 | A1 * | 11/2016 | Mizuguchi | B65H 3/5261 |
| 2017/0031295 | A1 | 2/2017 | Matsumoto | |
| 2018/0095399 | A1 | 4/2018 | Matsumoto | |

FOREIGN PATENT DOCUMENTS

| | | | |
|---|---|---|---|
| JP | 3602905 | B2 | 12/2004 |
| JP | 2017-030914 | A | 2/2017 |
| JP | 2017-048008 | A | 3/2017 |

* cited by examiner

SHEET FEEDING APPARATUS AND IMAGE FORMING APPARATUS

BACKGROUND OF THE INVENTION

Field of the Invention

The present invention relates to a sheet feeding apparatus configured to feed a sheet and to an image forming apparatus including the same.

Description of the Related Art

A sheet feeding apparatus for use in an image forming apparatus such as a printer, a copier and a multi-function printer widely adopts a separating mechanism such as a separation roller or a separation pad in order to separate a sheet fed by a feed roller or the like from another sheet to prevent double-feeding. These rollers and the separating mechanism are configured to be replaceable in a case where a surface of the roller wears due to friction with its performance deteriorating.

Japanese Patent Application Laid-open No. 2017-030914 discloses a door provided on a side surface of an image forming apparatus and configured to be opened such that a conveyance roller and a separation roller can be accessed for replacement from a downstream side of a sheet feeding apparatus in a sheet feeding direction. The abovementioned disclosure adopts this configuration to improve maintainability as compared to such a configuration that a cassette storing sheets needs to be drawn out in order to access a sheet feeding unit positioned deep inside a space within an apparatus body for replacing rollers and others.

While the sheet feeding apparatus of the abovementioned document adopts the configuration of accessing the roller to be replaced from the downstream side in the sheet feeding direction, there is a possibility that an operation of replacing the separation roller is performed in a state in which the conveyance roller is in contact with the separation roller. Then, there is a possibility that surfaces of the rollers are rubbed each other to be damaged when the separating roller in pressure contact with the conveyance roller is moved for replacement. More specifically, the surfaces of the rollers are more likely to be damaged in a case where the separation roller is moved in its axial direction in being taken out of the apparatus body.

SUMMARY OF THE INVENTION

The present invention provides a sheet feeding apparatus in which replacement of a component can be performed from a downstream side in a sheet feeding direction and which is capable of reducing rubbing between the component to be replaced and another component.

According to one aspect of the present invention, a sheet feeding apparatus includes: an apparatus body; a sheet stacking portion on which sheets are stacked and which is configured to be inserted into and drawn out of the apparatus body; a conveyance member configured to convey a sheet stacked on the sheet stacking portion in a sheet conveyance direction; a separating member configured to be in contact with the conveyance member and to separate the sheet conveyed by the conveyance member from another sheet; a disengaging mechanism configured to disengage the conveyance member and the separating member to be apart from each other; a unit attached to the apparatus body and configured to be detached from the apparatus body toward a downstream side in the sheet conveyance direction, wherein either one of the conveyance member and the separating member is provided in the unit and the other of the conveyance member and the separating member is provided in the apparatus body; and a restriction portion configured to restrict the unit from being attached to and detached from the apparatus body in a state where the conveyance member and the separating member are in contact with each other and to permit the unit to be attached to and detached from the apparatus body in a state where the conveyance member and the separating member are disengaged by the disengaging mechanism.

Further features of the present invention will become apparent from the following description of exemplary embodiments with reference to the attached drawings.

DESCRIPTION OF THE EMBODIMENTS

An image forming apparatus of the present disclosure will be described below with reference to the drawings. The image forming apparatus may be a printer, a copier, a facsimile machine or a multi-function printer configured to form an image on a sheet used as a recording medium based on image information inputted from an external personal computer or read from a document. The sheet used as the recording medium may be a plain sheet of paper, a paper for an envelope, a plastic film such as an overhead projector transparency (OHT) or a cloth.

First Embodiment

Figure 1:
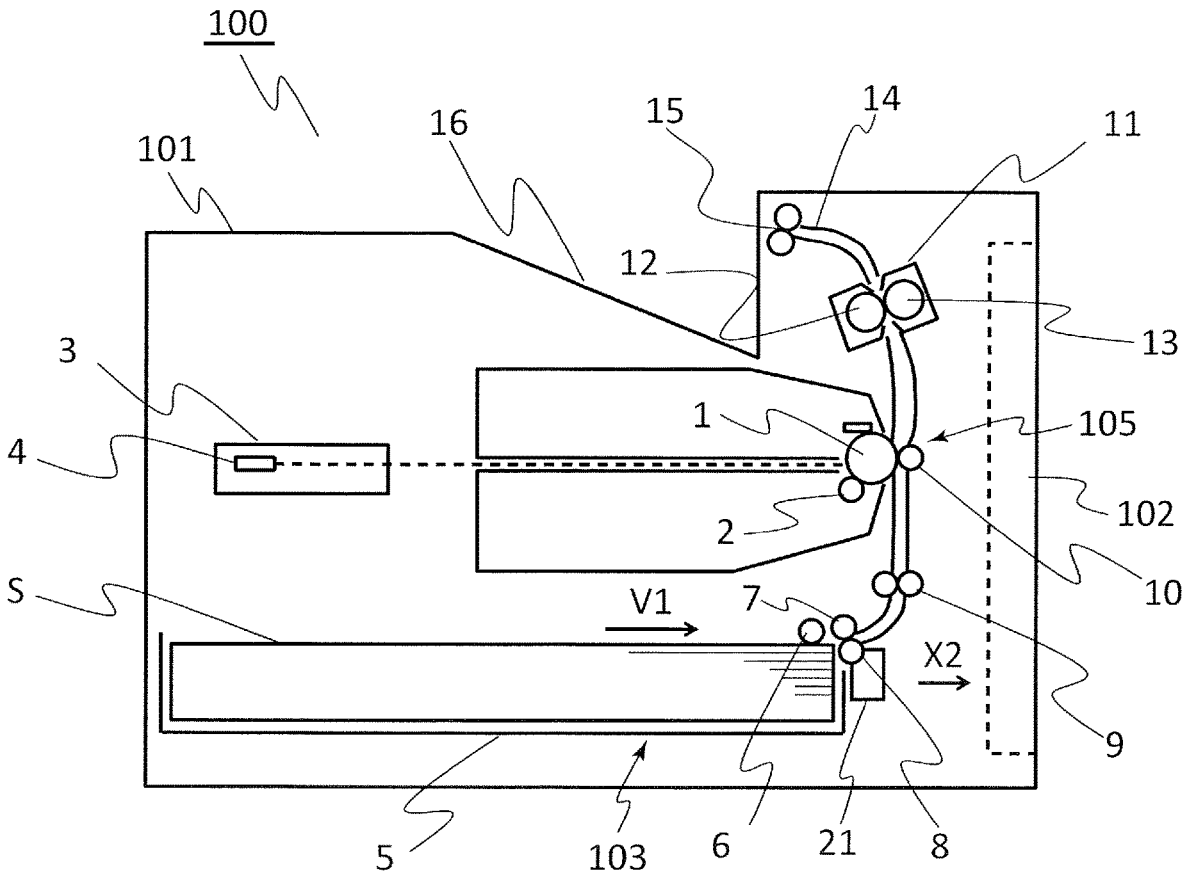
FIG. 1 is a schematic diagram illustrating an image forming apparatus of the present disclosure.

Firstly, an image forming apparatus 100 of a first embodiment will be described. The image forming apparatus 100 is a laser printer provided with an electrophotographic image forming portion 105. FIG. 1 is a schematic diagram illustrating a sectional structure of the image forming apparatus 100.

An image forming process of the image forming portion 105 will be described at first. The image forming apparatus 100 illustrated in FIG. 1 forms a toner image on a sheet S by electrophotographic image forming process. That is, the image forming portion 105 includes a rotatable photosensitive drum 1 serving as an image bearing member. A surface of the photosensitive drum 1 charged in advance is irradiated with a laser beam emitted from a light-emitting portion 4 included in an optical unit 3 to form an electrostatic latent image on the surface of the rotating photosensitive drum 1. Then, a developing roller 2 supplies toner, while rotating, on the latent image on the surface of the photosensitive drum 1 to form a toner image on the surface of the photosensitive drum 1.

In parallel with such toner image forming operation, the sheet S is fed from a sheet feeding apparatus 103 toward the image forming portion 105. The sheet S set in a sheet stacking tray, i.e., a sheet feed cassette, 5 attached in a lower part of an apparatus body 101 is fed by a pickup roller 6 and is conveyed to a registration roller 9 while being separated one by one by a feed roller 7 and a separation roller 8. The registration roller 9 conveys the sheet S to a transfer portion 10, synchronizing an arrival timing of the toner image on the surface of the photosensitive drum 1 with that of a leading edge position of the S. The transfer portion 10 transfers the toner image on the photosensitive drum 1 onto the sheet S by applied bias and pressure.

The sheet S is conveyed further to a fixing portion 11 and is nipped by a fixing roller 12 and a counter roller 13. Then, the toner image is pressed by being nipped by the roller pair and is applied with heat from a heat source, e.g., a halogen heater disposed inside the fixing roller 12, to fix the toner image onto the sheet S. The sheet S on which the image has been fixed is conveyed to a discharge roller 15 through a discharge conveyance path 14 and is discharged to a discharge portion 16 provided on an upper part of the apparatus body 101. Thus, the image forming process is finished.

The image forming portion 105 described above is one example of an image forming portion configured to form an image on a sheet S, and an intermediate transfer type electrophotographic unit or an ink-jet type printing unit for example may be used as the image forming portion.

Sheet Feeding Apparatus

Figure 2A:
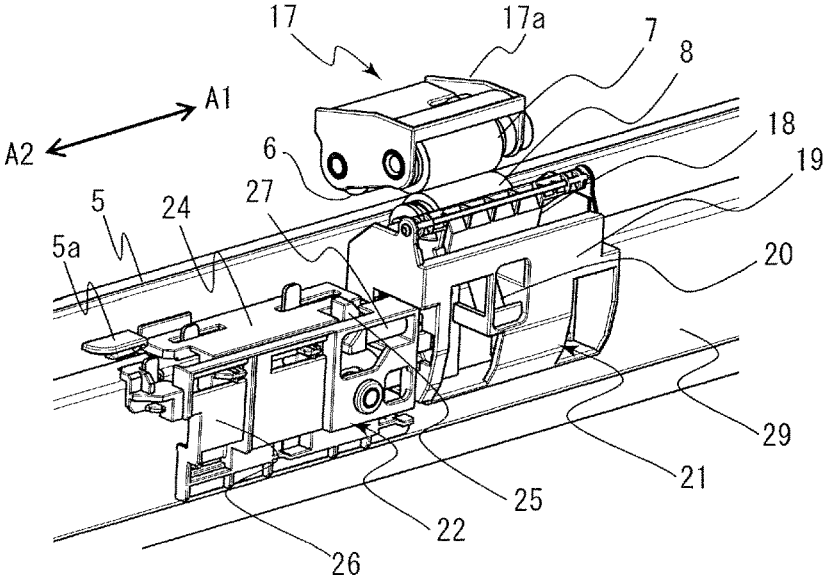
FIG. 2A is a perspective view illustrating a main part of a sheet feeding apparatus of a first embodiment.
Figure 2B:
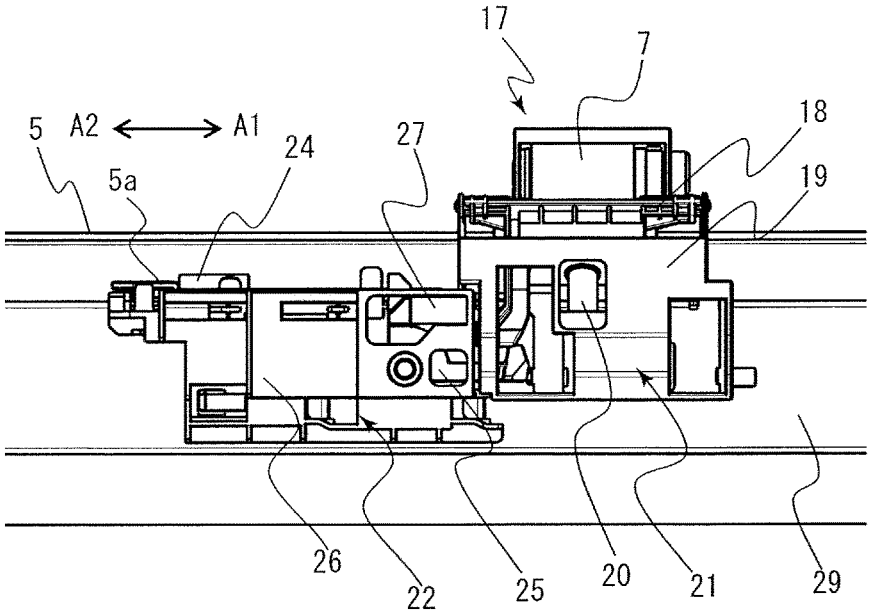
FIG. 2B is a side view of the main part.
Figure 2C:
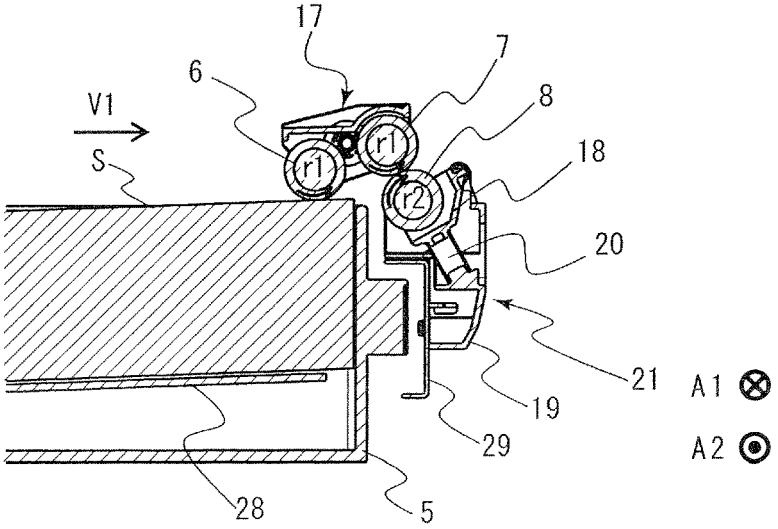
FIG. 2C is a section view of the main part.

The sheet feeding apparatus will be described with reference to FIGS. 2A, 2B and 2C. FIGS. 2A and 2B are perspective and side views of the sheet feeding apparatus seen from downstream in the sheet conveyance direction, i.e., from a right side of FIG. 1, and FIG. 2C is a section view of the sheet feeding apparatus seen from upstream in an insert direction of the sheet stacking tray 5. As seen in FIGS. 2A through 2C, the sheet feeding apparatus roughly includes the sheet stacking tray 5, a feed unit 17, a separation unit 21 and a disengaging mechanism 22. It is noted that a front direction of the image forming apparatus 100 in FIG. 1 (i.e., a direction from the apparatus toward a user operating the apparatus) is a direction vertical to a surface on which FIG. 1 is drawn.

The sheet stacking tray 5 is configured to be inserted into and drawn out of the apparatus body from the front side of the image forming apparatus 100 along a direction orthogonal to a sheet conveyance direction V1, i.e., along a width direction of the sheet S. Thereby, the sheet stacking tray 5 can be moved between an attachment position, i.e., a first position, where the sheet stacking tray 5 is attached and the sheet S can be fed and a draw-out position, i.e., a second position, where the sheet stacking tray 5 is drawn out of the apparatus body from the first position and sheets S can be replenished. The sheet stacking tray 5 is one example of a sheet stacking portion on which sheets are stacked and which is drawably attached to the apparatus body, and a box-type large volume cassette or a flat-shaped sheet feeding table, for example, may be used as the sheet stacking portion.

The pickup roller 6 and the feed roller 7 are rotatably held by a feed holder 17*a* and are rotated by driving force inputted from a driving source not illustrated. The feed holder 17*a* swings up and down centering on a rotation axis of the feed roller 7. It is noted that the feed roller 7 is one example of a conveyance member conveying a sheet fed from the sheet stacking portion, and a belt member may be also used as the conveyance member. It is also possible to configure such that the pickup roller 6 is omitted and the feed roller 7 directly comes into contact with the sheet S stacked on the sheet stacking tray 5.

The separation unit 21 includes a separation roller 8, a roller holder 18 rotatably holding the separation roller 8, a separation base 19 swingably supporting the roller holder 18 and a separating spring 20 configured to press the separation roller 8 against the feed roller 7. The separation roller 8 is held by the roller holder 18 through a torque limiter not illustrated. The separation roller 8 disposed to face the feed roller 7 is in contact (in pressure-contact) with the feed roller 7 and is rotatable following the feed roller 7. The separation roller 8 forms a separating portion in a form of a nip portion between the separation roller 8 and the feed roller 7, to separate the sheet S conveyed by the feed roller 7 from another sheet. A rotation axis of the separation roller 8 is positioned downstream in the sheet conveyance direction V1 (see FIG. 2C) of the rotation axis of the feed roller 7 in a view from a top. That is, the rotation axis of the separation roller 8 is positioned downstream of that of the feed roller 7 in a direction of detaching the separation unit 21. The separation roller 8 is one example of a separating member separating the sheets one by one. Instead of the separation roller 8, a pad member that comes into contact with the feed roller 7 or a retard roller into which a driving force in a counter direction against the sheet conveyance direction is inputted through a torque limiter may be used. The roller holder 18 is a holding member of the present embodiment holding the separating member. The separation base 19 is a base member of the present embodiment attached to the apparatus body in a state of supporting the holding member. The separating spring 20 is a pressure member of the present embodiment pressing the separating member against the conveyance member.

The disengaging mechanism 22 relatively moves the feed roller 7 and the separation roller 8 to engage and disengage (i.e., brings into contact and separates) the feed roller 7 and the separation roller 8 in response to insertion and draw-out of the sheet stacking tray 5 with respect to the apparatus body. The disengaging mechanism 22 also has a function of switching, in response to insertion and draw-out of the sheet stacking tray 5, whether or not the separation unit 21 can be attached to and detached from the apparatus body. That is, the disengaging mechanism 22 is a mechanism that engages and disengages the conveyance member and the separating member in linkage with the sheet stacking portion, and is also a switching mechanism that switches whether or not the separation unit 21 can be attached to and detached from the apparatus body in linkage with the sheet stacking portion. It is noted that as described later, a configuration of realizing the functions of the disengaging mechanism and the switching mechanism may be provided independently or a part of a member composing the respective mechanisms may be used in common.

As illustrated in FIG. 2A, the disengaging mechanism 22 includes a project portion 5*a* provided on the sheet stacking tray 5, a disengagement slider 24 serving as a slide member, a disengaging lever 25 serving as a turning member, a disengagement base 26 and a disengaging spring 27 serving as an urging member. The disengagement slider 24 is a first movable member in the present embodiment moved by the sheet stacking tray 5, and the disengaging lever 25 is a second movable member in the present embodiment moved by the first movable member. Structures and operations of the respective members composing the disengaging mechanism 22 will be described later in detail.

Operations from when the sheet stacking tray 5 is inserted into the apparatus body until when the sheet S is conveyed to the registration roller 9 will be described with reference to FIG. 2C. When the sheet stacking tray 5 is inserted into the apparatus body, the feed roller 7 and the separation roller 8 which have been separated by the disengaging mechanism 22 come into contact with each other. After that, when a printing job is started to be executed, a sheet supporting plate 28 provided in the sheet stacking tray 5 rises being driven by a lift motor (not illustrated) serving as a driving source. The sheet supporting plate 28 lifts the sheets S to a position where an uppermost sheet among the sheets S stacked on the sheet stacking tray 5 comes into contact with the pickup roller 6. Then, the feed unit 17 is driven by a feed motor not illustrated, and the pickup roller 6 and the feed roller 7 are both rotated in a rotation direction r1 along the sheet conveyance direction V1. In this case, the separation roller 8 rotates in a direction r2 following the feed roller 7 by a frictional force applied from the feed roller 7 or the uppermost sheet.

In a case of delivering the sheet by the pickup roller 6, there is a case where a sheet under the sheet in contact with the pickup roller 6 is delivered because of a frictional force between the sheets. If two or more sheets enter the nip portion between the feed roller 7 and the separation roller 8, because a blocking force of the separation roller 8 defined by a torque value of the torque limiter not illustrated is greater than this frictional force, the separating roller 8 stops and blocks movement of the second sheet and further sheets. The sheet S thus delivered out of the sheet stacking tray 5 by the pickup roller 6 is separated one by one by the feed roller 7 and the separation roller 8 and is conveyed to the registration roller 9 downstream in the sheet conveyance direction.

It is noted that while the separation unit 21 including the separation roller 8 will be described as being detachable from the apparatus body toward a downstream side in the sheet conveyance direction V1 in the following description, this technology is applicable also to a configuration in which a position relationship of the feed unit 17 and the separation unit 21 are exchanged. That is, this technology is applicable also to a configuration in which the unit including the conveyance member engaged with and disengaged from the separating member is detachable from the apparatus body toward the downstream side in the sheet conveyance direction. In such a case, it is possible to adopt a configuration in which the description concerning the separation roller 8 and the separation unit 21 is replaced with the feed roller 7 and the feed unit 17.

Disengaging Mechanism

Next, the disengaging mechanism 22 will be described. The disengaging mechanism 22 enables the operation of conveying the sheet S to the registration roller 9 while separating the sheet S one by one by bringing the separation roller 8 into contact with the feed roller 7 in the state in which the sheet stacking tray 5 is attached to the apparatus body. Meanwhile, the disengaging mechanism 22 disengages the feed roller 7 and the separation roller 8 when the sheet stacking tray 5 is drawn out of the apparatus body such that no sheet is left within the apparatus body and is damaged by being otherwise nipped between the feed roller 7 and the separation roller 8. It is because there is a case where an uppermost sheet left in the sheet stacking tray 5 is nipped in the nip portion between the feed roller 7 and the separation roller 8 when the sheet feeding apparatus finishes to continuously feed sheets. If the sheet stacking tray 5 is drawn out of the apparatus body in this state, the sheet is left within the apparatus body and is damaged when the sheet stacking tray 5 is attached again to the apparatus body. In contrast, the sheet is drawn out together with the sheet stacking tray 5 and no sheet is left within the apparatus body by disengaging the nip portion between the feed roller 7 and the separation roller 8 when the sheet stacking tray 5 is drawn out of the apparatus body. Thus, the disengaging mechanism 22 performs the operations of bringing the feed roller 7 and the separation roller 8 into contact and of disengaging these rollers in linkage with insertion and draw-out of the sheet stacking tray 5.

Figure 3A:
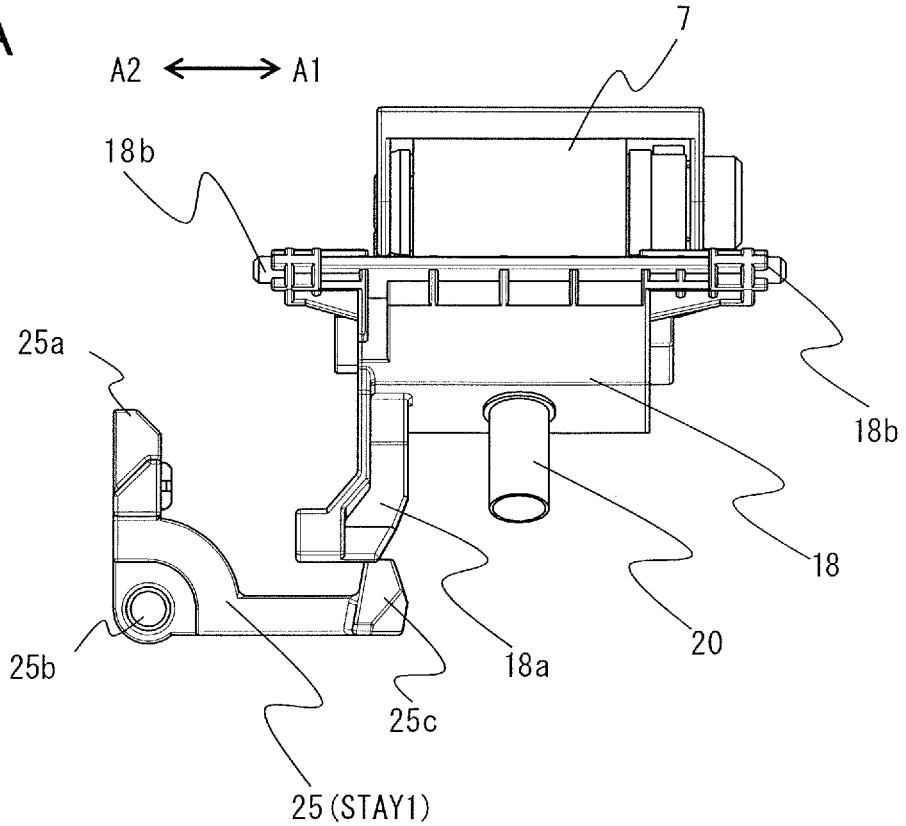
FIG. 3A is a side view illustrating a state in which a feed roller is in contact with a separation roller of the first embodiment.
Figure 3B:
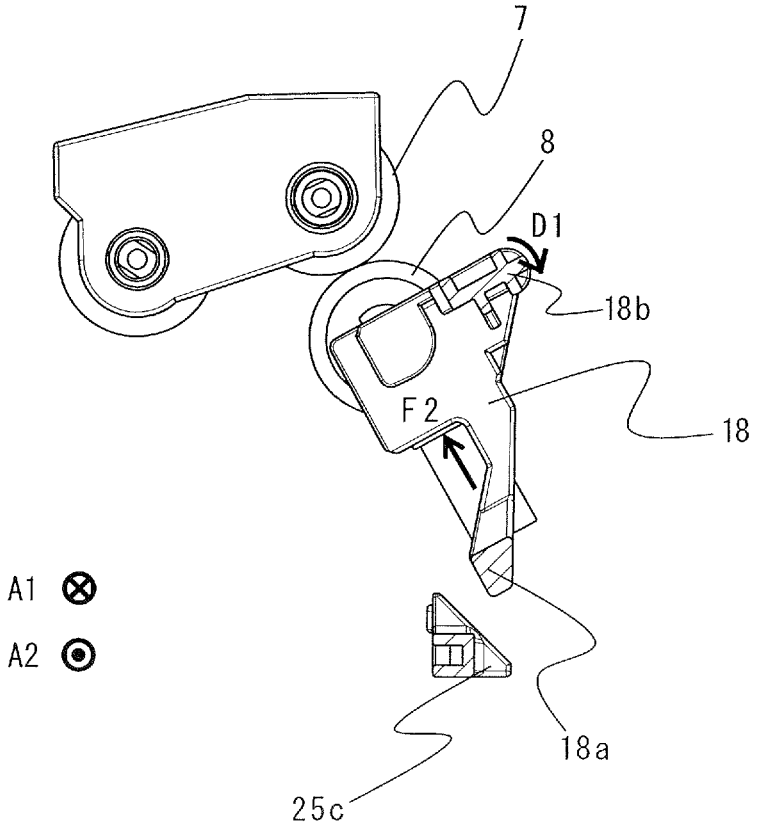
FIG. 3B is a section view corresponding to FIG. 3A.
Figure 4A:
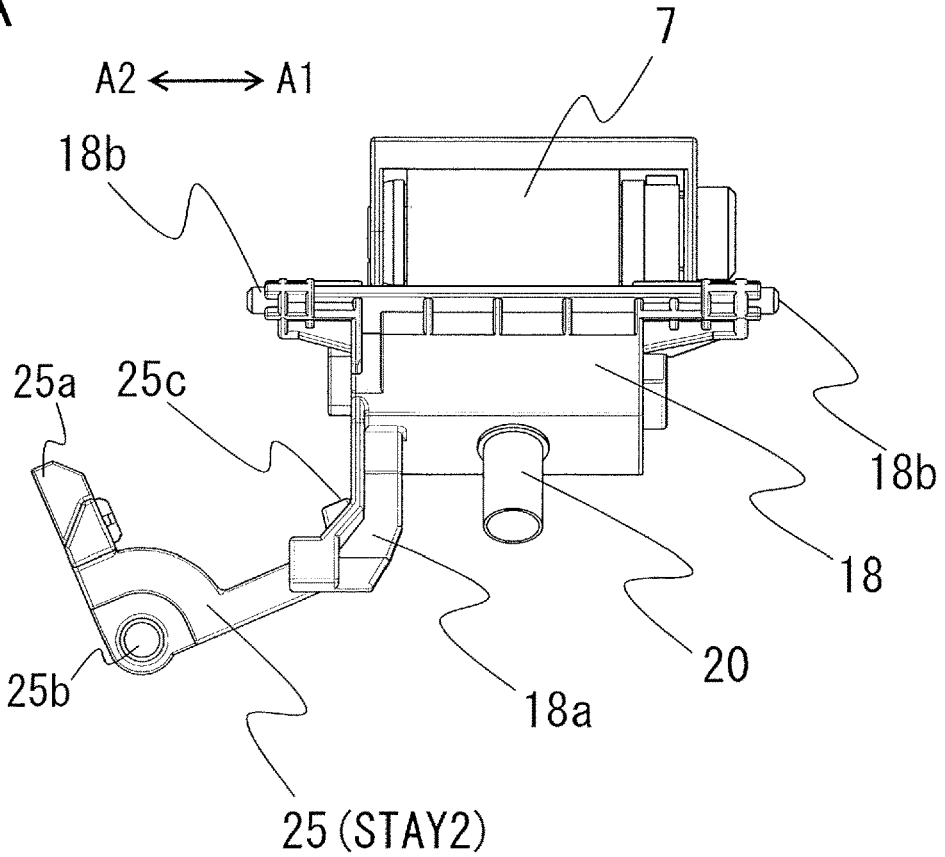
FIG. 4A is a side view illustrating a state in which the feed roller and the separation roller of the first embodiment are disengaged from each other.
Figure 4B:
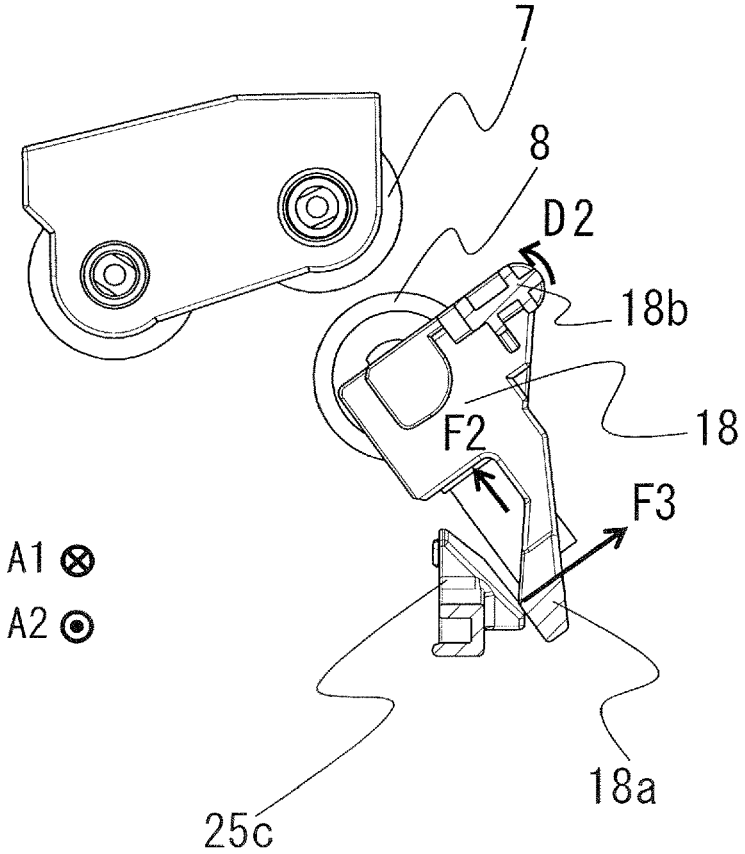
FIG. 4B is a section view corresponding to FIG. 4A.

A mechanism by which the disengaging mechanism 22 brings the feed roller 7 and the separation roller 8 into contact and disengages these rollers will be described below. FIGS. 3A and 3B illustrate a state in which these rollers are in contact with each other. That is, FIG. 3A is a side view illustrating the state seen from downstream in the sheet conveyance direction and FIG. 3B is a side view illustrating the state seen from upstream in the insert direction A1 of the sheet stacking tray 5. FIGS. 4A and 4B illustrate a state in which the rollers have been disengaged from each other, wherein FIG. 4A is a side view illustrating the state seen from downstream in the sheet conveyance direction and FIG. 4B is a side view illustrating the state in a view from upstream in the insert direction A1 of the sheet stacking tray 5.

At first, a structure of the disengaging mechanism 22 will be described with reference to FIGS. 2A through 3B. The disengagement base 26 is attached to a holding plate 29, and a disengagement slider 24 is supported by the disengagement base 26 slidably in the insert direction A1 and in a draw-out direction A2. The disengaging lever 25 is supported by the disengagement base 26 turnably centering on a turning fulcrum 25*b* and is urged so as to turn by the disengaging spring 27 centering on the turning fulcrum 25*b* in a direction C2 (see FIG. 6B). The disengaging lever 25 is also provided with a receiving arm 25*a* engageable with a pressing portion 24*a* of the disengagement slider 24 and an acting arm 25*c* engageable with an arm portion 18*a* of the roller holder 18. The holding plate 29 is attached to a feed frame not illustrated and to which each feed mechanism for unitizing the sheet feeding apparatus is attached. It is noted that the holding plate 29 may be directly fixed to a frame of the apparatus body. The holding plate 29 may be also configured so as to function as a member supporting a rail portion movably supporting the sheet stacking tray 5.

As illustrated in FIGS. 3A and 3B, when the disengaging lever 25 is positioned at a first standby position (indicated as "STAY-1" hereinafter), the arm portion 18*a* of the roller holder 18 rotatably holding the separation roller 8 is disengaged from the acting arm 25*c* of the disengaging lever 25. Here, the roller holder 18 supported swingably centering on a swing fulcrum 18*b* is urged in a direction D1 (see FIG. 3B) by an urging force F2 of the separating spring 20. Thereby, the roller holder 18 swings in a direction D1, and the state in which the separation roller 8 held by the roller holder 18 is pressed against 7 is maintained.

Next, when the disengaging lever 25 is positioned at a second standby position (indicated as "STAY-2" hereinafter) as illustrated in FIGS. 4A and 4B, the arm portion 18*a* of the roller holder 18 is in contact, i.e., engaged, with a slope of the acting arm 25*c*. In this case, the disengaging lever 25 is urged by the disengaging spring 27 counterclockwise in FIG. 4A centering on the turning fulcrum 25*b*. Still further, urging forces of the disengaging spring 27 and the separating spring 20 are set such that a force of the disengaging lever 25 pressing the arm portion 18*a* of the roller holder 18 is greater than the force urging the roller holder 18 to press against the feed roller 7. Due to that, the acting arm 25*c* of the disengaging lever 25 presses the arm portion 18*a* of the roller holder 18 with a pressure F3 resisting against the urging force F2 of the separating spring 20, and the roller holder 18 swings in a direction D2 centering on the swing fulcrum 18*b*. Thereby, the roller holder 18 swings in the direction D2, and the separation roller 8 held by the roller holder 18 is disengaged from the feed roller 7.

Figure 5A:
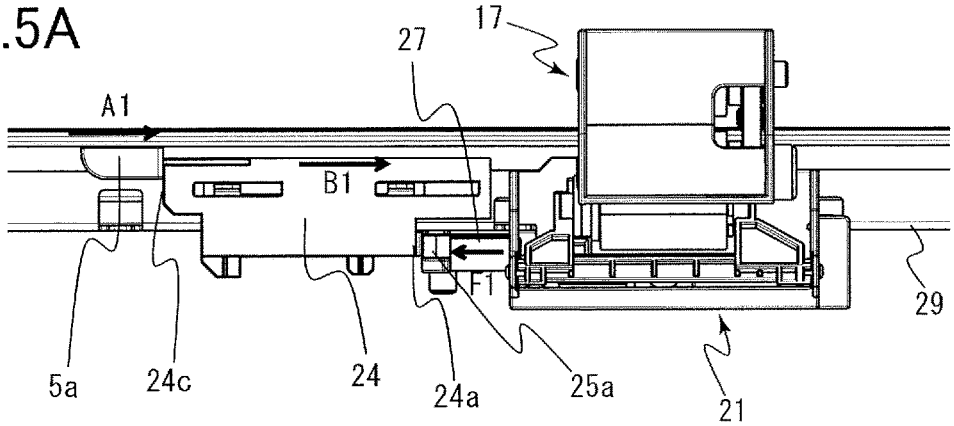
FIG. 5A is a top view of a disengaging mechanism of the first embodiment, illustrating an operation in a case where a tray is inserted.
Figure 5B:
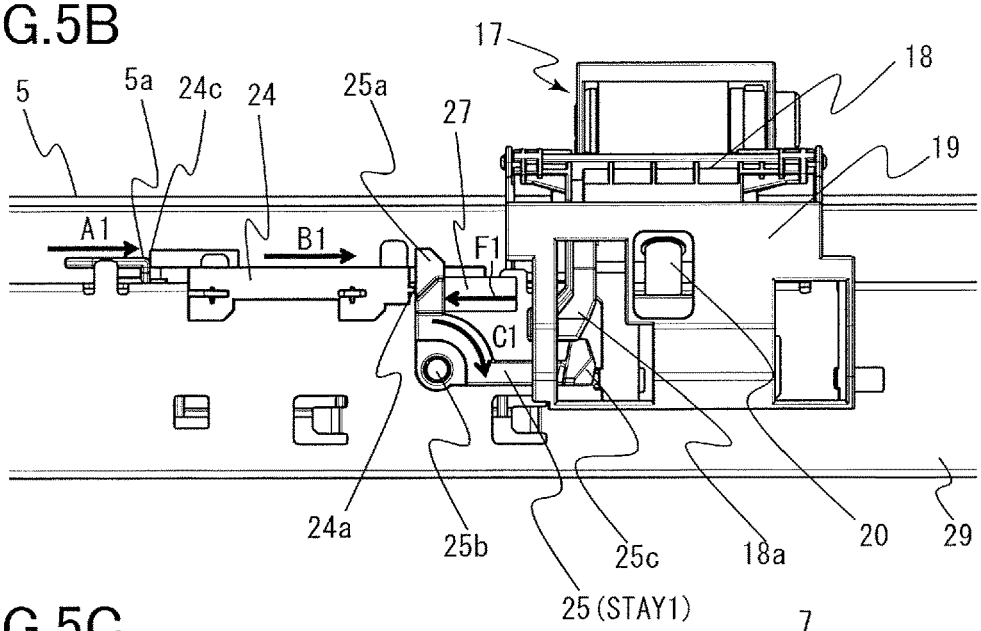
FIG. 5B is a side view illustrating the abovementioned operation.
Figure 5C:
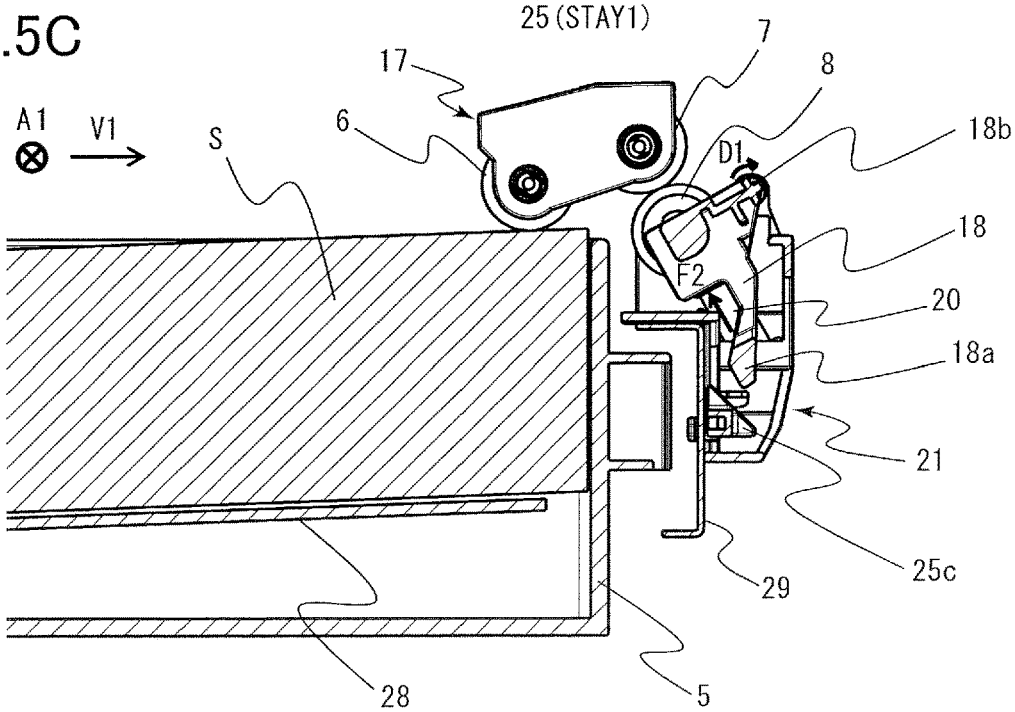
FIG. 5C is a section view illustrating the abovementioned operation.
Figure 6A:
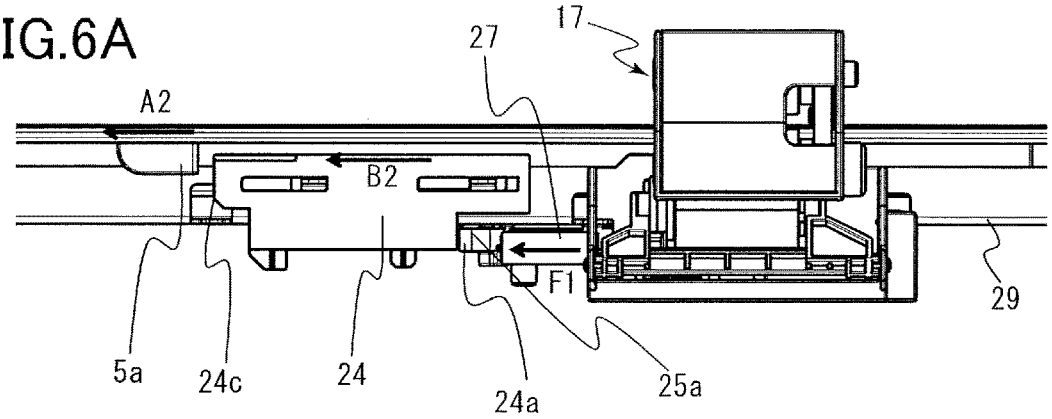
FIG. 6A is a top view of the disengaging mechanism of the first embodiment, illustrating an operation in drawing out the tray.
Figure 6B:
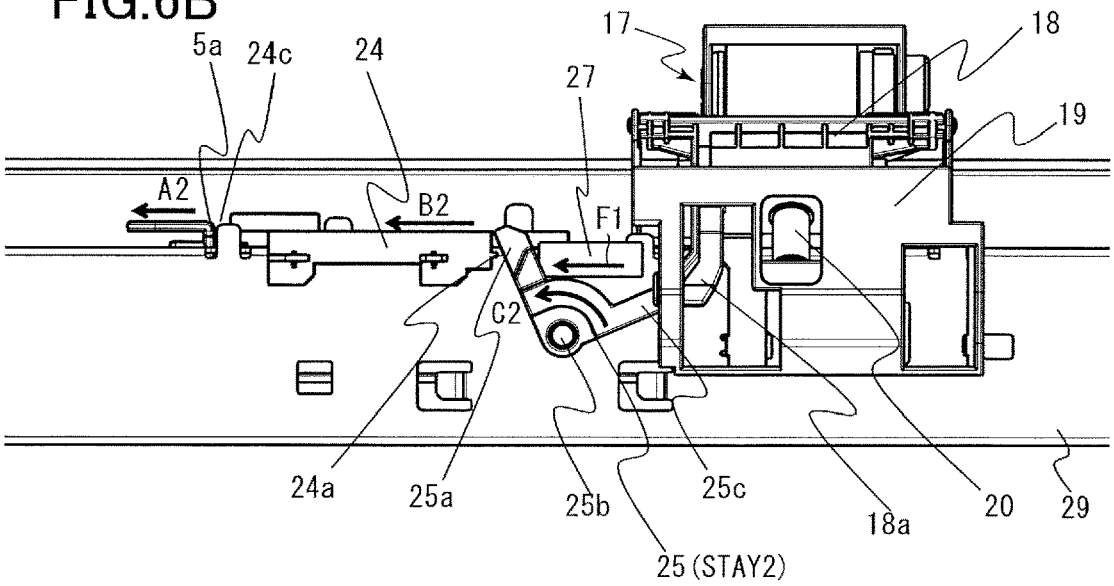
FIG. 6B is a side view illustrating the abovementioned operation.
Figure 6C:
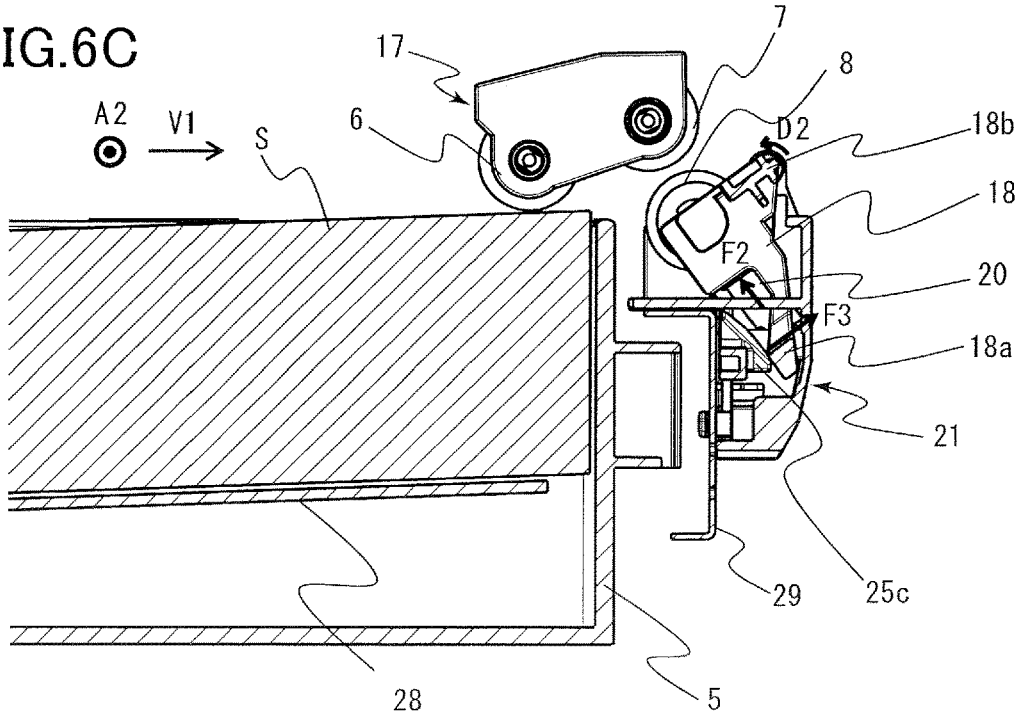
FIG. 6C is a section view illustrating the abovementioned operation.

A structure for moving the disengaging lever 25 in linkage with insertion and draw-out of the sheet stacking tray 5 will be described with reference to FIGS. 5A through 6C. FIG. 5A through 5C illustrate the operation of the disengaging mechanism 22 in inserting the sheet stacking tray 5, wherein FIG. 5A is a top view, FIG. 5B is a side view seen from downstream in the sheet conveyance direction and FIG. 5C is a section view seen from upstream in the insert direction A1. FIGS. 6A through 6C illustrate the operation of the disengaging mechanism 22 in a case where the sheet stacking tray 5 is drawn out, wherein FIG. 6A is a top view, FIG. 6B is a side view seen from downstream in the sheet conveyance direction, and FIG. 6C is a section view seen from upstream in the insert direction A1. It is noted that the disengagement base 26 (see FIG. 2A) is not illustrated in each drawing of FIGS. 5 and 6.

As illustrated in FIG. 5A, when the sheet stacking tray 5 is inserted into the image forming apparatus in the insert direction A1, the project portion 5*a* provided on the sheet stacking tray 5 abuts at first against and presses an abutment portion 24*c* of the disengagement slider 24 and the disengagement slider 24 slides in a direction B1. Then, as illustrated in FIG. 5B, a pressing portion 24*a* provided in the disengagement slider 24 engages with the receiving arm 25*a* of the disengaging lever 25 and presses the disengaging lever 25. Then, the disengaging lever 25 turns in the direction C1 centering on the turning fulcrum 25*b* resisting against the urging force F1 of the disengaging spring 27, and the acting arm 25*c* of the disengaging lever 25 moves to the first standby position STAY-1. When the disengaging lever 25 is positioned at the first standby position STAY-1, the feed roller 7 is in contact with the separation roller 8 as described above (see FIG. 5C). Thus, the disengaging mechanism 22 converts the direction of the force received from the sheet stacking tray 5 by its configuration including the first and second movable members, i.e., the disengagement slider 24 and the disengaging lever 25, to bring the feed roller 7 into contact with the separation roller 8.

When the sheet stacking tray 5 is drawn out of an attachment position within the image forming apparatus in the direction A2 as illustrated in FIG. 6A, the project portion 5*a* of the sheet stacking tray 5 moves at first in the direction A2. Here, the disengagement slider 24 is urged in the draw-out direction A2 of the tray by the disengaging spring 27 through the disengaging lever 25. The disengagement slider 24 released from the pressure of the project portion 5*a* along with draw-out of the sheet stacking tray 5 slides in the direction B2 in accordance to the urging force F1 of the disengaging spring 27 as illustrated in FIG. 6B. At the same time, the disengaging lever 25 turns in the direction C2 centering on the turning fulcrum 25*b* by the urging force F1 of the disengaging spring 27, and the acting arm 25*c* of the disengaging lever 25 moves to the second standby position STAY-2 from the first standby position STAY-1. As the disengaging lever 25 moves to the second standby position STAY-2, the feed roller 7 is disengaged from the separation roller 8 as described above (see FIG. 6C). It is noted that as contact between the project portion 5*a* of the sheet stacking tray 5 and the disengagement slider 24 is released, the feed roller 7 and the separation roller 8 having been in contact with each other are switched to be totally disengaged. That is, as the project portion 5*a* of the sheet stacking tray 5 is disengaged from the disengagement slider 24, the position of the disengaging lever 25 is changed from the position as illustrated in FIG. 3A to the position as illustrated in FIG. 4A, and the separation roller 8 is totally disengaged from the feed roller 7. Timing when the separation roller 8 is disengaged from the feed roller 7 is preferable to be right after when the sheet stacking tray 5 is started to be drawn out of the attachment position in order not to damage the uppermost sheet in drawing the sheet stacking tray 5 out of the attachment position.

Structure for Replacing Separation Unit

Figure 7A:
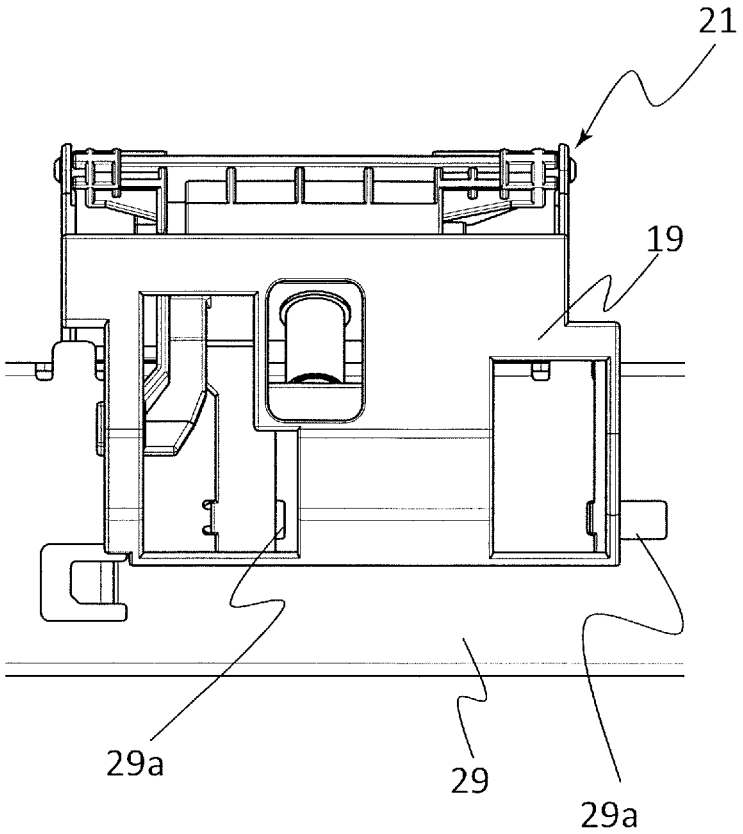
FIG. 7A is a side view illustrating an attachment configuration of a separation unit of the first embodiment seen from downstream in the sheet conveyance direction.
Figure 7A:
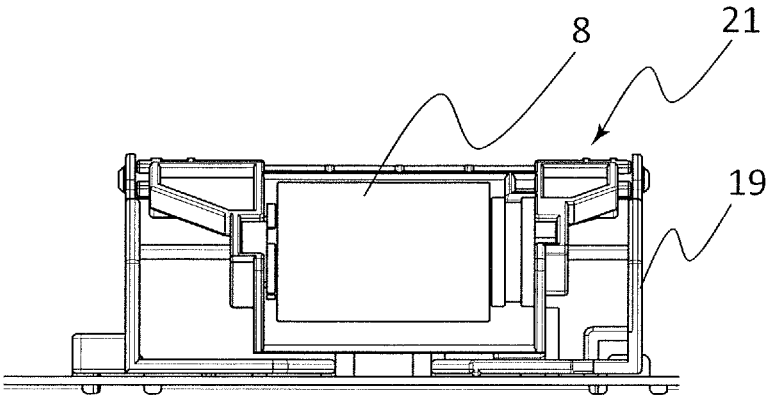
Figure 7B:
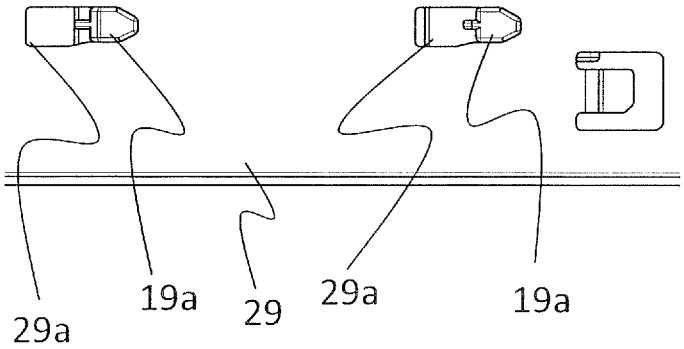
FIG. 7B is a side view illustrating the attachment configuration seen from an opposite side from FIG. 7A.
Figure 8A:
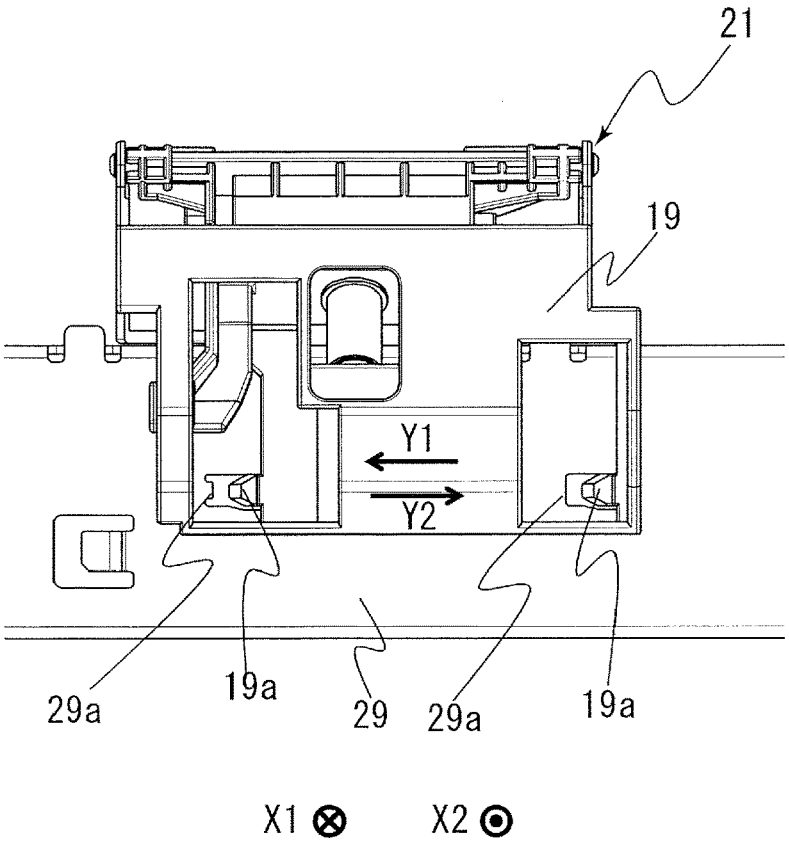
FIG. 8A is a side view illustrating an operation by which the separation unit of the first embodiment is fixed to/released from an apparatus body seen from downstream in the sheet conveyance direction.
Figure 8B:
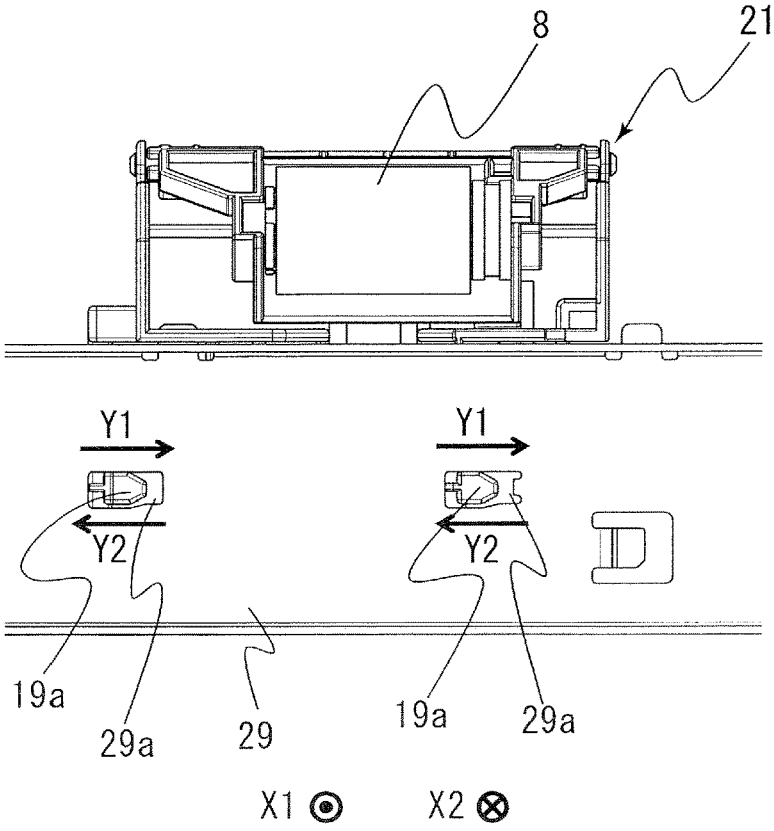
FIG. 8B is a side view illustrating the attachment configuration seen from an opposite side from FIG. 8A.

Next, a structure for attaching/detaching the separation unit 21 to/from the apparatus body will be described with reference to FIGS. 7A and 7B and FIGS. 8A and 8B. FIGS. 7A and 7B illustrate a state after when the separation unit 21 is attached to the holding plate 29 fixed to the apparatus body, wherein FIG. 7A is a side view seen from downstream in the sheet conveyance direction and FIG. 7B is a side view seen from upstream in the sheet conveyance direction. FIGS. 8A and 8B illustrate a state before when the separation unit 21 is fixed to the holding plate 29, wherein FIG. 8A is a side view seen from downstream in the sheet conveyance direction and FIG. 8B is a side view seen from upstream in the sheet conveyance direction.

As illustrated in FIGS. 7A and 7B, the separation base 19 of the separation unit 21 is provided with a plurality of claw portions 19*a*, each serving as an engagement claw, configured to be engageable with holes 29*a* of the holding plate 29 each serving as an engagement portion configured to engage with the claw portion 19*a*. In a state in which the separation unit 21 is fixed to the holding plate 29, i.e., in a state in which the claw portions 19*a* are engaged with the holes 29*a* of the holding plate 29, the separation base 19 cannot be moved downstream in the sheet conveyance direction with respect to the holding plate 29, and detachment of the separation unit 21 from the holding plate 29 is restricted. It is noted that while two claws and two holes are provided in the present embodiment, the number of claws and holes may be one each or three each or more as long as the separation unit 21 can be attached to the holding plate 29.

In a case where the separation unit 21 is detached, the separation unit 21 is slid once in a direction Y2 intersecting with a detachment direction X2 as illustrated in FIGS. 8A and 8B to release the engagement of the claw portions 19*a* with the holes 29*a*. After that, the separation unit 21 is moved in the detachment direction X2 heading downstream in the sheet conveyance direction (i.e., in a direction popping out from a surface on which FIG. 8A is drawn) to be detached such that the claw portions 19*a* of the separation base 19 get out of the hole 29*a* of the holding plate 29. In a case of attaching the separation unit 21 on the other hand, the separation unit 21 is moved in the attachment direction X1 opposite to the detachment direction X2 (i.e., in a direction toward the backside of a surface on which FIG. 8A is drawn through the surface) to insert the claw portions 19*a* of the separation base 19 into the holes 29*a* of the holding plate 29. Then, the separation unit 21 is slid in the direction Y1 opposite to the direction Y2 to engage the claw portions 19*a* with the holes 29*a*.

As illustrated in FIG. 1, the image forming apparatus 100 is provided, on a side thereof, with a door cover 102 openable with respect to the apparatus body 101 and covers the separation unit 21 from a downstream side in the detachment direction X2 when the cover 102 is closed. The door cover 102 is provided so as to be opened for removing a jammed sheet in a case when a sheet is jammed in the sheet feeding apparatus or in a conveyance path guiding the sheet fed from the sheet feeding apparatus and to maintain the sheet feeding apparatus and the conveyance path. An operator can access to the separation unit 21 from downstream in the detachment direction X2, i.e., from the downstream side in the sheet conveyance direction, by opening the door cover 102 to a right side in FIG. 1. This configuration is advantageous over a configuration in which an operator performs replacement of the separation unit 21 from an upstream side in the sheet feeding direction or from either side in an axial direction of the separation roller 8 (i.e., from either side in the sheet width direction) in that replacement of the separation unit 21 becomes easier for the operator. That is, this configuration enables to readily assure a work space and visibility of the separation unit 21 as compared to the configuration in which the operator accesses to the separation unit 21 through a space in which the sheet stacking tray 5 is attached to the apparatus body 101. It is noted that the door cover 102 is merely one example of an openable member covering the unit to be replaced, and another configuration that enables the operator to take out the unit by opening an openable member other than a door member may be adopted.

Mechanism to Enable/Disable Attachment and Detachment of Separation Unit

Figure 9A:
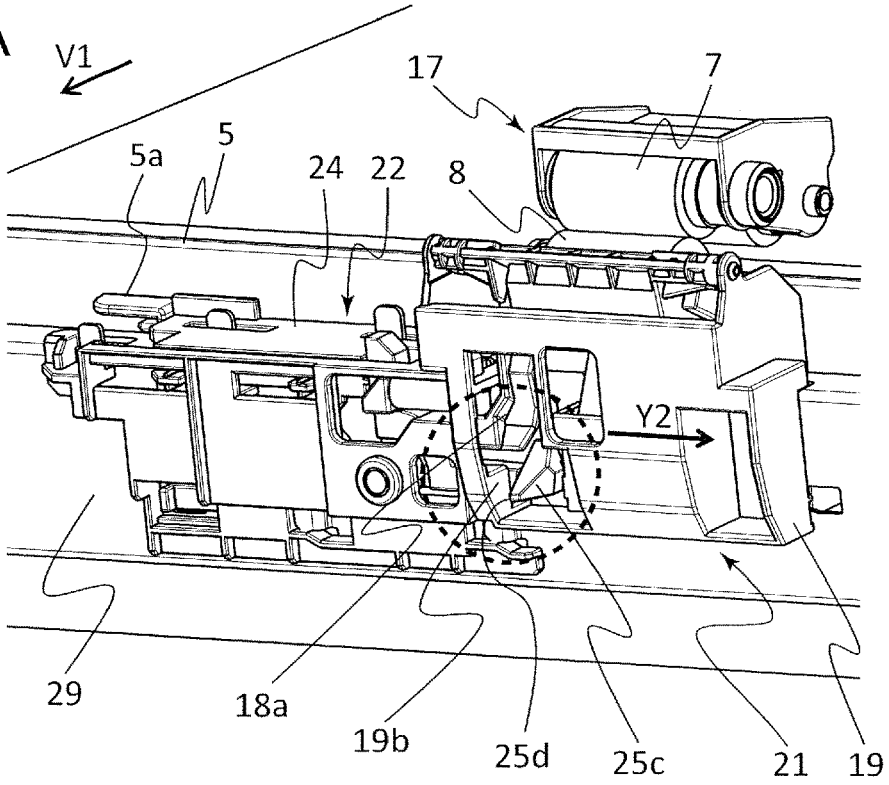
FIG. 9A is a perspective view illustrating a configuration for restricting the separation unit from being detached in a state in which the tray is inserted in the first embodiment.
Figure 9B:
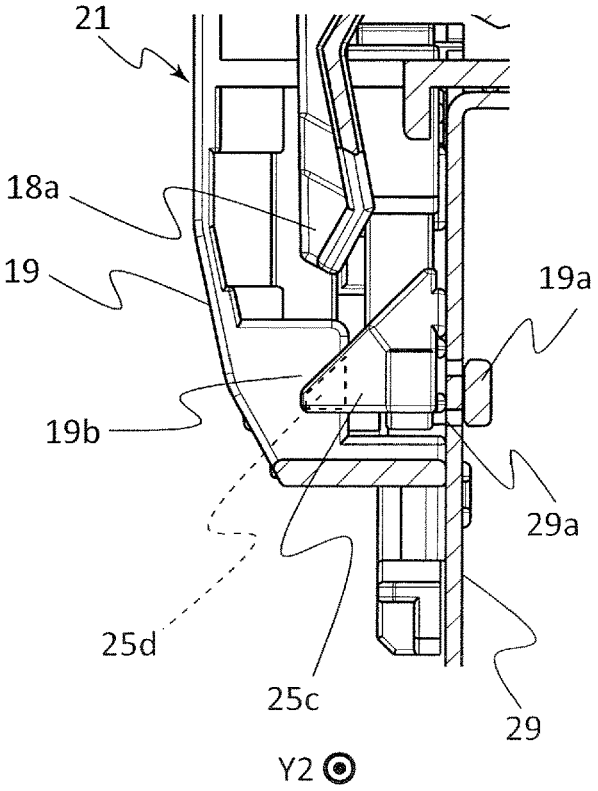
FIG. 9B is a section view illustrating a main part of the configuration illustrated in FIG. 9A.
Figure 10A:
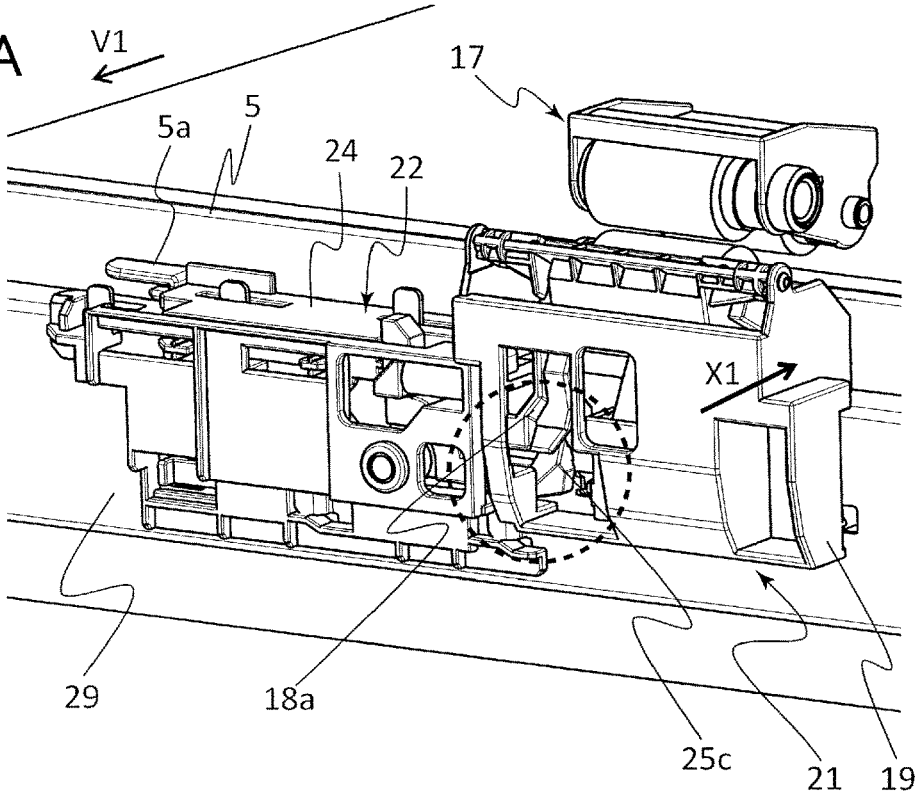
FIG. 10A is a perspective view illustrating a configuration for restricting the separation unit from being attached in the state in which the tray is inserted in the first embodiment.
Figure 10B:
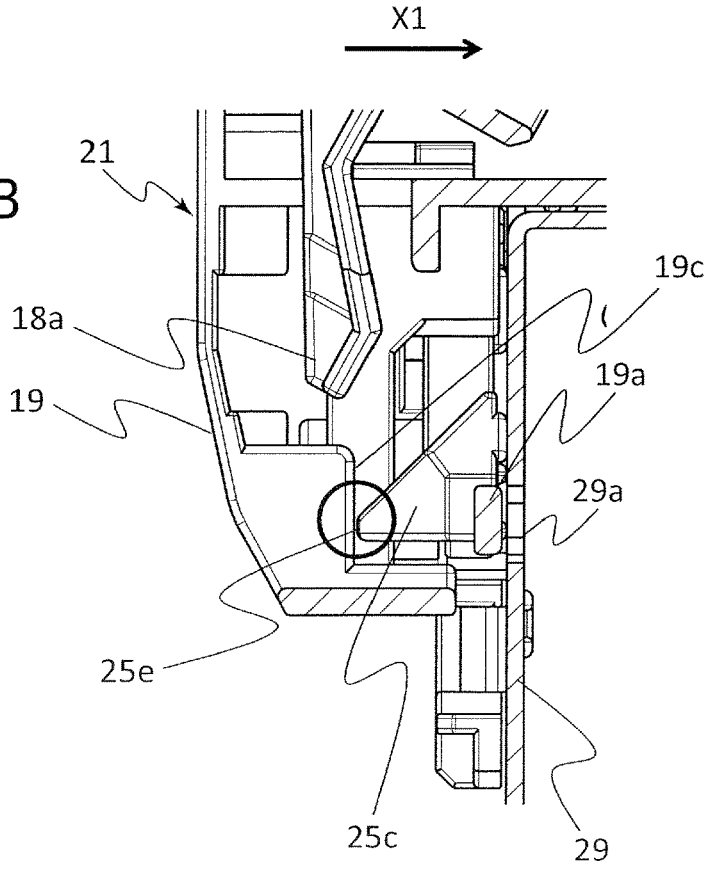
FIG. 10B is a section view illustrating a main part of the configuration illustrated in FIG. 10A.

Next, a mechanism, i.e., a switching mechanism, for switching whether or not the unit to be replaced can be attached to and detached from the apparatus body will be described with reference to FIGS. 9A through 12B. In the present embodiment, the function of the switching mechanism is realized by using a member composing the disengaging mechanism 22. Each drawing of FIGS. 9A through 10B illustrates the state in which the sheet stacking tray 5 is inserted into the apparatus body. FIG. 9A is a perspective view illustrating the sheet feeding apparatus attached with the separation unit 21 and seen from downstream in the sheet conveyance direction V1, and FIG. 9B is a section view of the separation unit 21 seen from downstream in the insert direction A1. FIG. 10A is a perspective view illustrating an intermediate state of the operation of attaching the separation unit 21 to the holding plate 29 by moving the separation unit 21 in the attachment direction X1, and FIG. 10B is a section view of the separation unit 21 seen from downstream in the tray insert direction A1. Meanwhile, each drawing of FIGS. 11A through 12B illustrates the state in which the sheet stacking tray 5 is drawn out of the apparatus body.

Figure 11A:
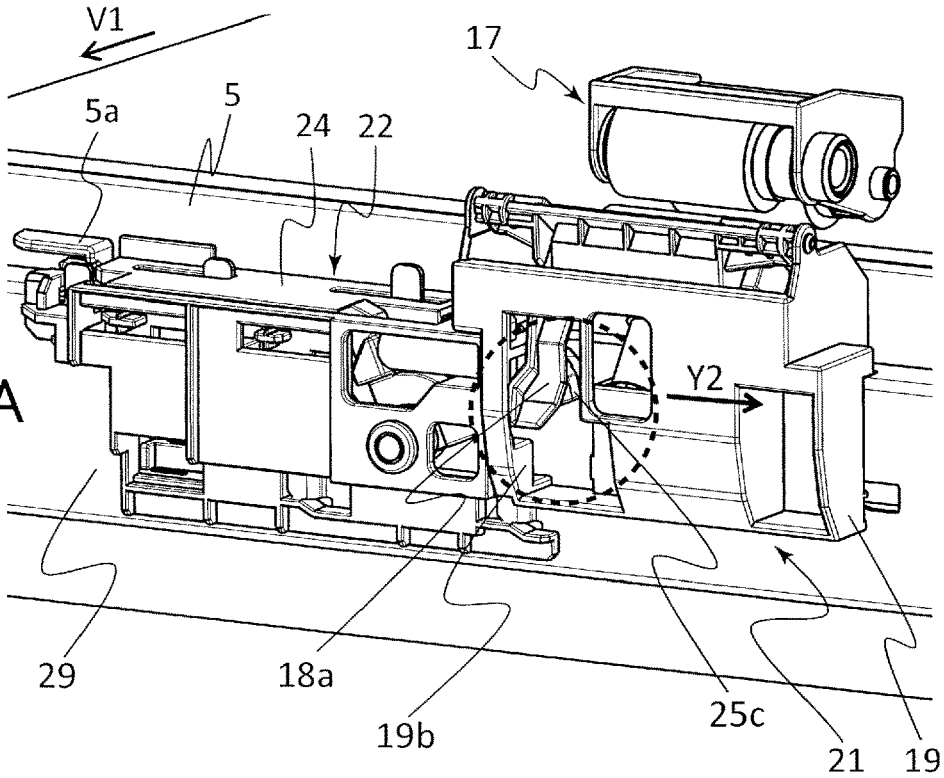
FIG. 11A is a perspective view illustrating a state in which detachment of the separation unit is permitted in a state in which the tray is drawn out in the first embodiment.
Figure 11B:
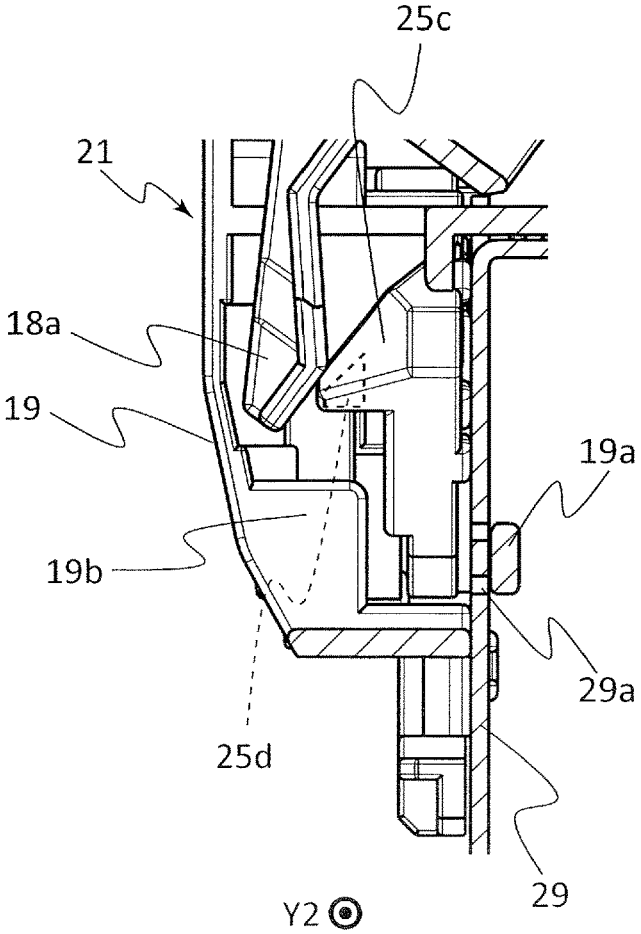
FIG. 11B is a section view illustrating a main part of the configuration illustrated in FIG. 11A.
Figure 12A:
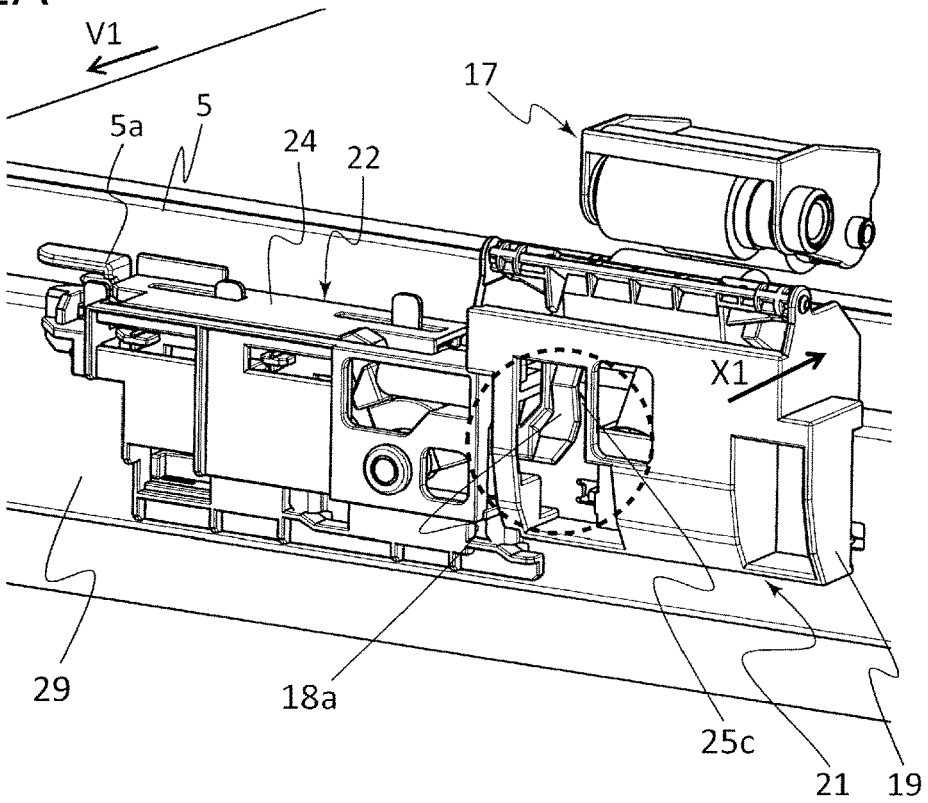
FIG. 12A is a perspective view illustrating a state in which attachment of the separation unit is permitted in the state in which the tray is drawn out in the first embodiment.
Figure 12B:
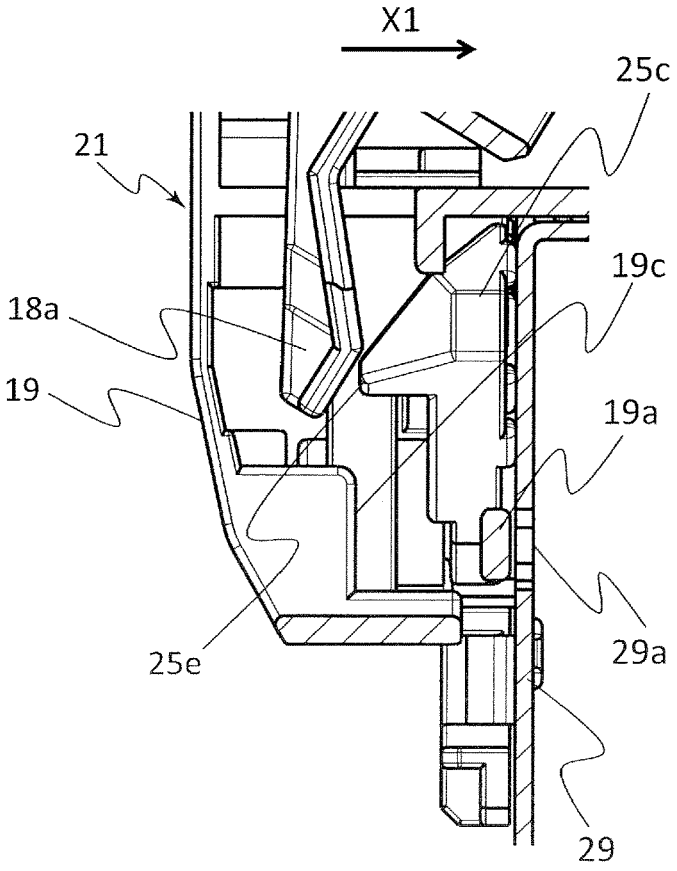
FIG. 12B is a section view illustrating a main part of the configuration illustrated in FIG. 12A.

FIG. 11A is a perspective view illustrating the sheet feeding apparatus before the separation unit 21 is detached seen from downstream in the sheet conveyance direction V1, and FIG. 11B is a section view illustrating the separation unit 21 seen from downstream in the tray insert direction A1. FIG. 12A is a perspective view illustrating an intermediate state of the operation of detaching the separation unit 21 out of the holding plate 29 by moving the separation unit 21 in the detachment direction X2 direction, and FIG. 12B is a section view illustrating the separation unit 21 seen from downstream in the insert direction A1.

Tray Inserted State

The disengaging lever 25 is positioned at the first standby position STAY-1 by the action of the disengaging mechanism 22 in the state in which the sheet stacking tray 5 is attached being inserted into the image forming apparatus in the insert direction A1 as described above.

As illustrated in FIGS. 9A and 9B, the separation base 19 is provided with a stopper portion 19*b* so as to face, in the direction Y2, the acting arm 25*c* of the disengaging lever 25 at the first standby position. In other words, the disengaging lever 25 includes a first restriction portion 25*d* configured to face the separation unit 21 in the state in which the sheet stacking tray 5 is inserted into the apparatus body and to restrict movement of the separation unit 21 in the direction Y2 of releasing the fixation of the separation unit 21. Even if the separation unit 21 is tried to be moved in the direction Y2 to detach from the holding plate 29 in the state in which the sheet stacking tray 5 is inserted into the apparatus body, the first restriction portion 25*d* at a distal end of the acting arm 25*c* of the disengaging lever 25 obstructs the stopper portion 19*b* of the separation base 19. Due to that, the claw portions 19*a* of the separation base 19 are not disengaged from the holes 29*a* of the holding plate 29, and the separation unit 21 cannot be detached from the holding plate 29. Thus, movement of the separation unit 21 is restricted such that the separation unit 21 cannot be detached in the state in which the separation unit 21 and the sheet stacking tray 5 are attached to the apparatus body (or the holding plate 29).

Still further, as illustrated in FIGS. 10A and 10B, the separation base 19 is provided with a second stopper portion 19*c* so as to face, in the attachment direction X1, to the acting arm 25*c* of the disengaging lever 25 positioned at the first standby position. In other words, the disengaging lever 25 includes a second restriction portion 25*e* configured to restrict movement of the separation unit 21 in the attachment direction X1 approaching to the holding plate 29 in the state in which the sheet stacking tray 5 is inserted into the apparatus body. Even if the separation unit 21 is tried to be attached to the holding plate 29 in the state in which the sheet stacking tray 5 is inserted into the apparatus body, the second restriction portion 25*e* at a distal end of the acting arm 25*c* of the disengaging lever 25 obstructs the second stopper portion 19*c* of the separation base 19. Due to that, the claw portions 19*a* of the separation base 19 cannot be inserted into the holes 29*a* of the holding plate 29, and the separation unit 21 cannot be attached to the holding plate 29. Thus, the separation base 19 is restricted such that the claw portions 19*a* of the separation base 19 cannot be engaged with the holes 29*a* of the holding plate 29 in the state in which the separation unit 21 is detached from the apparatus body and in which the sheet stacking tray 5 is attached to the apparatus body in the state. Thereby, the separation unit 21 cannot be attached to the apparatus body (or the holding plate 29) in the state in which the sheet stacking tray 5 is attached to the apparatus body.

Thus, in the present embodiment, the disengaging lever 25 composing the disengaging mechanism 22 acts as the restriction portion restricting the separation unit 21 from being attached to and detached from the apparatus body in the state (i.e., the first state) in which the disengaging lever 25 is positioned at the first standby position. Due to that, the both operations of attaching/detaching the separation unit 21 to/from the holding plate 29 are restricted in the state in which the sheet stacking tray 5 is inserted into a predetermined position (i.e., the first position) within the image forming apparatus, i.e., in the state in which the feed roller 7 is in contact with the separation roller 8. Then, it is possible to avoid trouble such as damages on surfaces of the rollers otherwise caused by sliding friction of the rollers concerned in a case of performing the operation of attaching/detaching the separation unit 21 in the state in which the feed roller 7 is in contact with the separation roller 8.

Tray Drawn-Out State

The disengaging lever 25 is positioned at the second standby position STAY-2 by the action of the disengaging mechanism 22 in the state in which the sheet stacking tray 5 is drawn out of the image forming apparatus in the draw-out direction A2 as described above.

As illustrated in FIGS. 11A and 11B, in the case where the disengaging lever 25 is positioned at the second standby position, the acting arm 25*c* of the disengaging lever 25 recedes from the position where the acting arm 25*c* obstructs the stopper portion 19*b* provided in the separation base 19. That is, the first restriction portion 25*d* moves to a position where the first restriction portion 25*d* does not overlap with the stopper portion 19*b* and recedes from a moving locus of the separation base 19 as seen from the direction Y2 in which the fixation of the separation base 19 is released. Therefore, it is possible to move the separation base 19 in the direction Y2 to disengage the claw portions 19*a* from the holes 29*a* of the holding plate 29 and to detach the separation unit 21 from the holding plate 29.

As illustrated also in FIGS. 12A and 12B, in the case where the disengaging lever 25 is positioned at the second standby position, the acting arm 25*c* of the disengaging lever 25 recedes also from the position where the acting arm 25*c* obstructs the second stopper portion 19*c* provided in the separation base 19. That is, the second restriction portion 25*e* moves to the position where the second restriction portion 25*e* does not overlap with the second stopper portion 19*c* seen from the attachment direction X1 in which the separation base 19 is made to approach to the holding plate 29. Therefore, it is possible to move the separation base 19 in the attachment direction X1 to insert the claw portions 19*a* into the holes 29*a* of the holding plate 29 and to attach the separation unit 21 to the holding plate 29 by engaging the claw portions 19*a* with the holes 29*a* of the holding plate 29.

Thus, in the state in which the disengaging lever 25 serving as the restriction portion is positioned at the second standby position, i.e., in the second state, the separation unit 21 is permitted to be attached to and detached from the apparatus body. Therefore, when the sheet stacking tray 5 is positioned at the draw-out position (i.e., at the second position), that is, in the state in which the feed roller 7 is disengaged from the separation roller 8, it becomes possible to perform the both operations of attaching/detaching the separation unit 21 to/from the holding plate 29.

In other words, the separation unit 21 may be attached to and detached from the holding plate 29 in the state in which the feed roller 7 is disengaged from the separation roller 8. That is, when the sheet stacking tray 5 is drawn out of the attachment position (i.e., the first position) and the project portion 5*a* of the sheet stacking tray 5 separates from the disengagement slider 24, the feed roller 7 is totally disengaged from the separation roller 8 as described above. Due to that, because the feed roller 7 is totally disengaged from the separation roller 8 on the way of drawing the sheet stacking tray 5 out of the apparatus body, it is possible to attach/detach the separation unit 21 by stopping the sheet stacking tray 5 in the course of the draw-out operation. That is, while the separation unit 21 may be attached and detached in the state in which the sheet stacking tray 5 is totally drawn out to the second position, the separation unit 21 may be also attached and detached by stopping the sheet stacking tray 5 on the way of the draw-out operation as long as the project portion 5*a* has been separated from the disengagement slider 24.

Modified Examples

In the configuration of the present embodiment, the separation unit 21 is restricted from being detached by the stopper portion 19*b* and the first restriction portion 25*d*, and the separation unit 21 is restricted from being attached by the second stopper portion 19*c* and the second restriction portion 25*e*. However, instead of the configuration in which the stopper portions 19*b* and 19*c* are provided in one projecting member, the respective stopper portions may be provided on separate members. Still further, instead of the configuration in which the structures corresponding to the first restriction portion 25*d* and the second restriction portion 25*e* are disposed in a single member (e.g., the disengaging lever 25 in the present embodiment), they may be provided in different members moving in linkage with insertion and draw-out of the sheet stacking tray 5.

Second Embodiment

Next, a second embodiment of the present disclosure will be described. The present embodiment is different from the first embodiment in configurations of attaching/detaching the separation unit 21 to/from the apparatus body and of restricting attachment and detachment of the separation unit 21. The same configuration with the first embodiment other than that will be denoted by the reference numerals common with those of the first embodiment and an explanation thereof will be omitted here.

In the disengaging mechanism 22 of the present embodiment, the configuration of realizing the functions of bringing the separation roller 8 and the feed roller 7 into contact and of disengaging those rollers in linkage with insertion and draw-out of the sheet stacking tray 5 is same with that of the first embodiment. That is, the disengaging mechanism 22 includes the disengagement slider 24 slid by the sheet stacking tray 5 and the disengaging lever 25 turned by the disengagement slider 24, and the position of the separation roller 8 is determined depending on at which of the standby positions the disengaging lever 25 is positioned.

However, as described below, the separation unit 21 is configured such that the separation unit 21 can be detached from the holding plate 29 by operating an elastic switching portion, i.e., a slidablity switching portion 21*a*. Still further, the separation unit 21 is provided with a configuration (i.e., a shutter member 30) of switching whether or not the separation unit 21 can be attached to and detached from the apparatus body in linkage with insertion and draw-out of the sheet stacking tray 5.

Structure for Replacing Separation Member

Figure 13A:
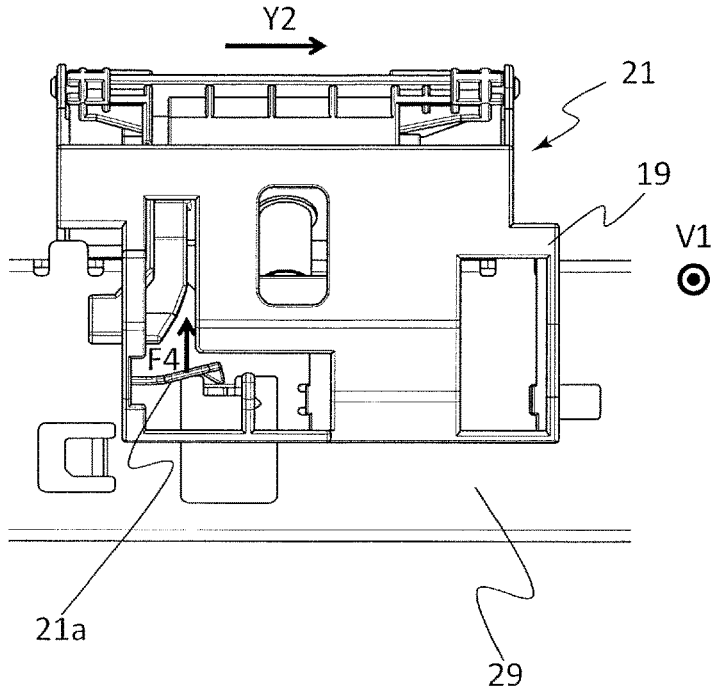
FIG. 13A is a side view illustrating a state in which a switching portion is operated in the separation unit of a second embodiment.
Figure 13B:
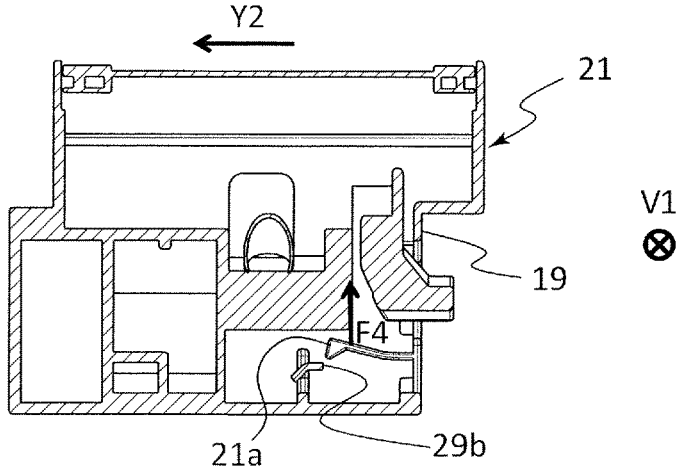
FIG. 13B is a section view illustrating the abovementioned state.
Figure 13C:
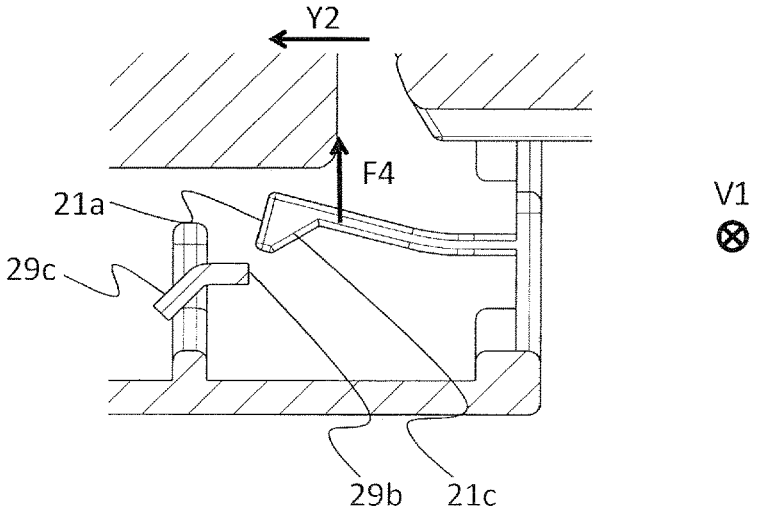
FIG. 13C is an enlarged section view illustrating the switching portion in the state illustrated in FIGS. 13A and 13B.

A structure for attaching and detaching the separation unit 21 will be described with reference to FIGS. 13A through 14C. FIGS. 13A through 13C illustrate a state in which the slidability switching portion 21*a* of the separation unit 21 is operated by a pressing operation, and FIGS. 14A through 14C illustrate a state in which the switching portion 21*a* is not operated, wherein FIGS. 13A and 14A are side views of the separation unit 21 seen from downstream in the sheet conveyance direction V1, FIGS. 13B and 14B are section views of the separation unit 21 seen from upstream in the sheet conveyance direction V1, and FIGS. 13C and 14C are enlarged views a main part thereof.

Figure 14A:
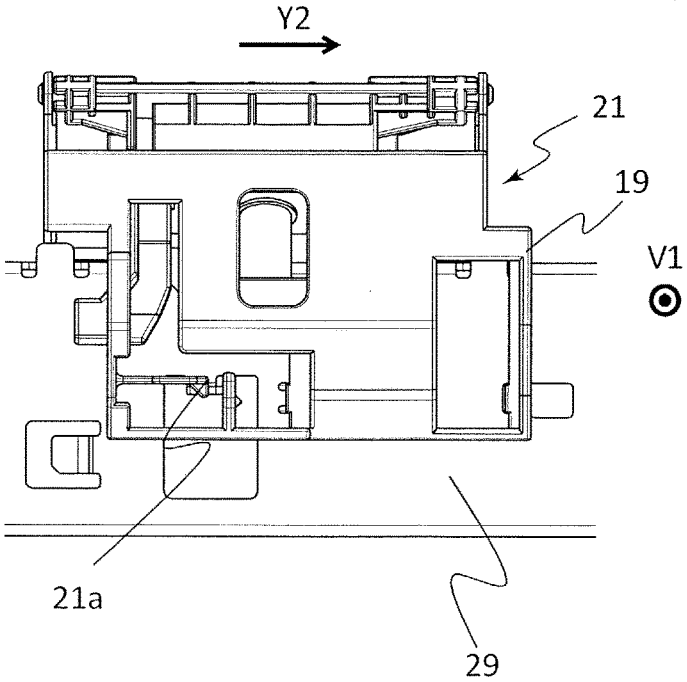
FIG. 14A is a side view illustrating a state in which the switching portion is not operated in the separation unit of the second embodiment.

As illustrated in FIGS. 13A and 14A, the separation base 19 of the separation unit 21 is provided with the slidability switching portion 21*a* configured to be abuttable with the apparatus body. The separation unit 21 is an elastic member composed of sheet metal, synthetic resin or the like and is configured to return to its original neutral position (e.g., a position as illustrated in FIG. 14A) even if it is deformed. In a case where the slidability switching portion 21*a* is positioned at the neutral position, the slidability switching portion 21*a* is disposed so as to face a slide restricting portion 29*b* provided in the holding plate 29 and can restrict the separation unit 21 from moving in the direction the Y2.

Operations in the present embodiment will be described more specifically. In a case where the separation unit 21 is to be detached from the holding plate 29, the operator presses the slidability switching portion 21*a* upward as illustrated in FIGS. 13B and 13C. Then, the slidability switching portion 21*a* elastically deforms upward by a pressure F4 and recedes from a position where the slidability switching portion 21*a* is obstructed by the slide restricting portion 29*b* of the holding plate 29. In other words, an edge portion of the slidability switching portion 21*a* moves to a position where the slidability switching portion 21*a* does not overlap with the slide restricting portion 29*b* seen in the direction Y2 in which the separation unit 21 is moved to release engagement of the claw portions 19*a* of the separation base 19 with the holes 29*a* of the holding plate 29. Due to that, it is possible to detach the separation unit 21 from the holding plate 29 by sliding the separation unit 21 in the direction Y2.

Figure 14B:
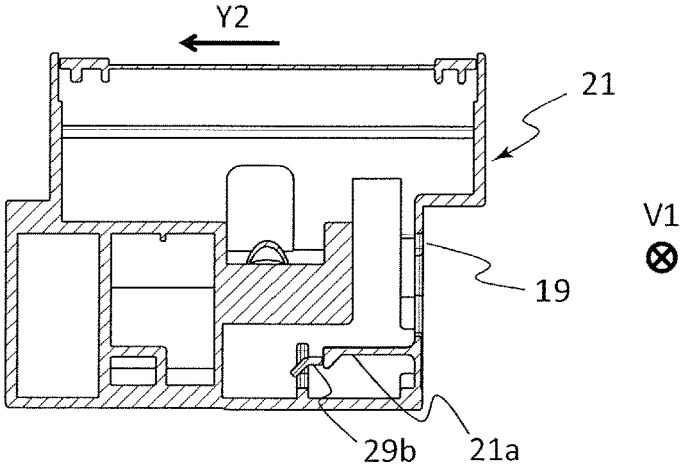
FIG. 14B is a section view illustrating the abovementioned state.
Figure 14C:
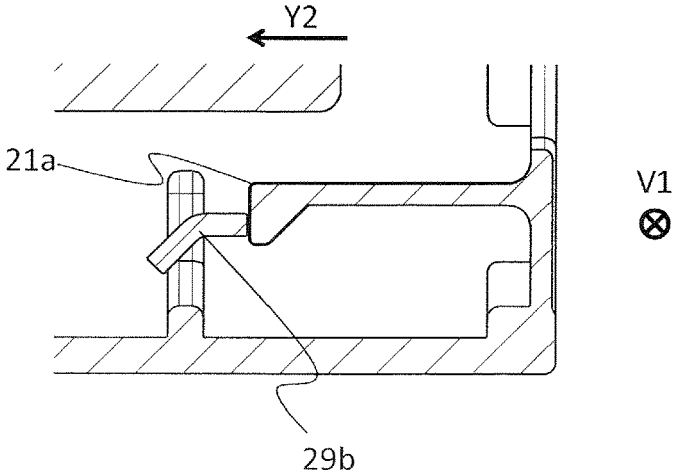
FIG. 14C is an enlarged section view of the switching portion in the state illustrated in FIGS. 14A and 14B.

Meanwhile, when the operator releases his/her hand from the slidability switching portion 21*a*, the slidability switching portion 21*a* returns to its neutral position by its own elasticity as illustrated in FIGS. 14B and 14C and stands by at the position where the slidability switching portion 21*a* is obstructed by the slide restricting portion 29*b* of the holding plate 29. In other words, the slidability switching portion 21*a* stands by in the state in which the edge portion of the slidability switching portion 21*a* overlaps with the slide restricting portion 29*b* in a view from the direction Y2. Due to that, even if the separation unit 21 is tried to be slid in the direction Y2, it is unable to slide the separation unit 21 in the direction Y2 because the slidability switching portion 21*a* is obstructed by the slide restricting portion 29*b*. That is, the separation unit 21 cannot be detached from the holding plate 29 unless the slidability switching portion 21*a* is operated.

It is noted that the operations of attaching/detaching the separation unit 21 to/from the holding plate 29 are the same with those of the first embodiment (see FIGS. 8A and 8B for example) other than that the manipulation of the slidability switching portion 21*a* is required. That is, it is possible to detach the separation unit 21 by disengaging the claw portions 19*a* from the holes 29*a* of the holding plate 29 by sliding the separation unit 21 in the direction Y2 while pressing the slidability switching portion 21*a* and then by moving the separation unit 21 downstream in the sheet conveyance direction V1. It is also possible to attach the separation unit 21 to the holding plate 29 by moving the separation unit 21 in the direction Y1 after inserting the claw portions 19*a* into the holes 29*a* of the holding plate 29 by moving the separation unit 21 upstream in the sheet conveyance direction V1. It is noted that the slidability switching portion 21*a* and the slide restricting portion 29*b* are provided with slopes 21*b* and 29*c* for automatically making the slidability switching portion 21*a* to recede in the case where the separation unit 21 is moved in the direction Y1.

Mechanism to Enable/Disable Attachment and Detachment of Separation Unit

Figure 15:
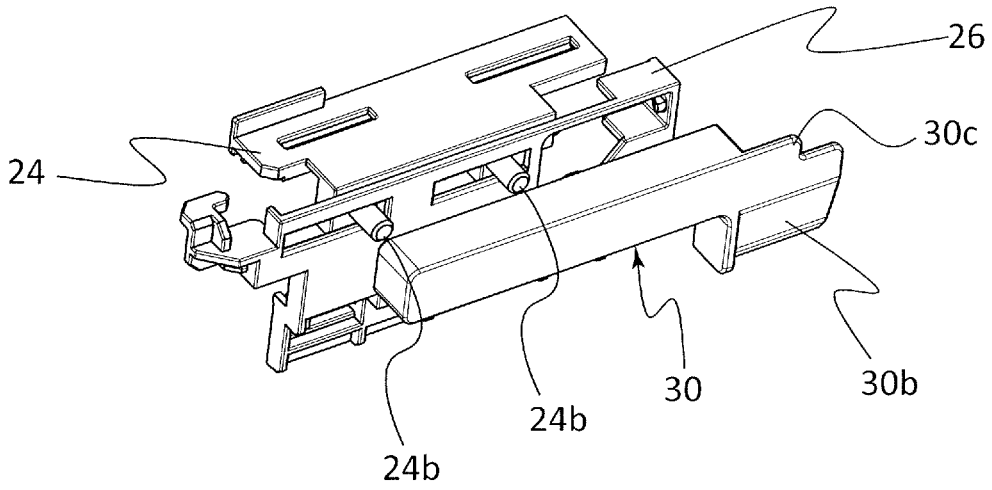
FIG. 15 is a perspective view of a shutter member of the second embodiment.

Next, a mechanism for switching propriety of attaching/detaching the separation unit 21 by utilizing the slidability switching portion 21*a* provided in the separation unit 21 will be described. FIG. 15 is a perspective view of a shutter member 30 added to the disengaging mechanism 22 in the present embodiment. As illustrated in FIG. 15, the shutter member 30, which is another example of the restriction portion configured to restrict attachment and detachment of the separating member, is provided with fitting holes not illustrated into which a project portions 24*b* of the disengagement slider 24 is press-fitted. Then, press-fitting the project portions 24*b* of the disengagement slider 24 into the fitting holes of the shutter member 30, the shutter member 30 and the disengagement slider 24 are combined and moves together.

Figure 16A:
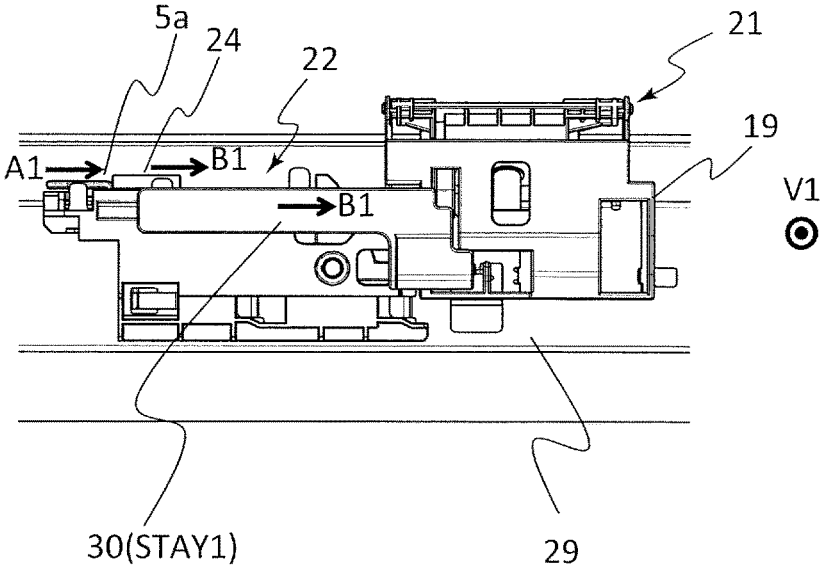
FIG. 16A is a side view illustrating a configuration of restricting the separation unit from being detached in the state in which the tray is inserted in the second embodiment.
Figure 16B:
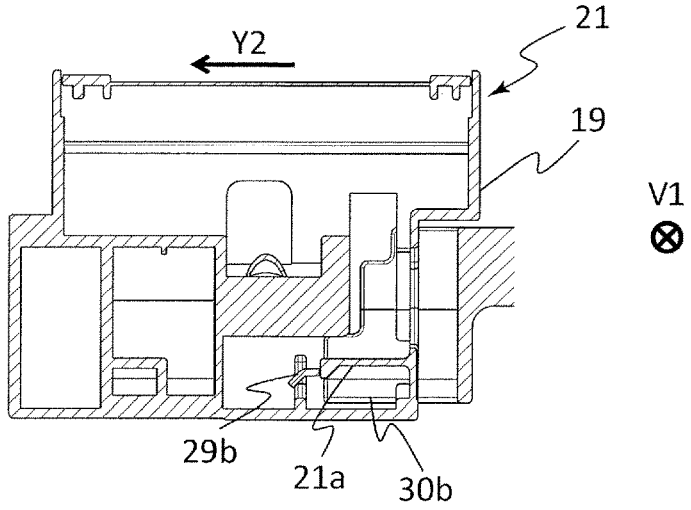
FIG. 16B is a section view illustrating the state illustrated in FIG. 16A.
Figure 16C:
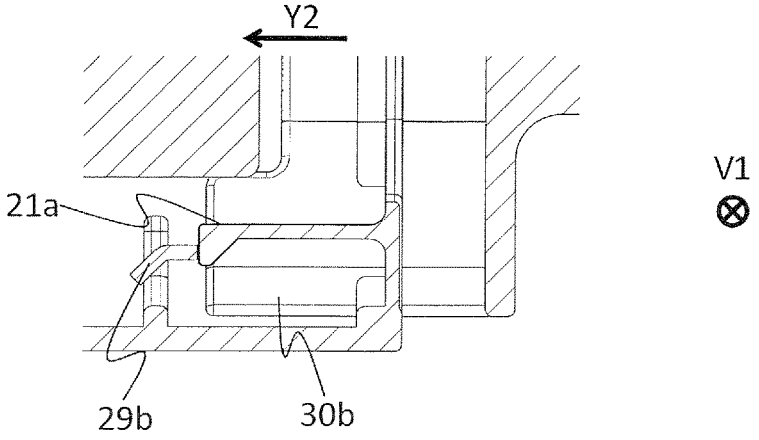
FIG. 16C is an enlarged section view of the switching portion in the state illustrated in FIGS. 16A and 16B.
Figure 17A:
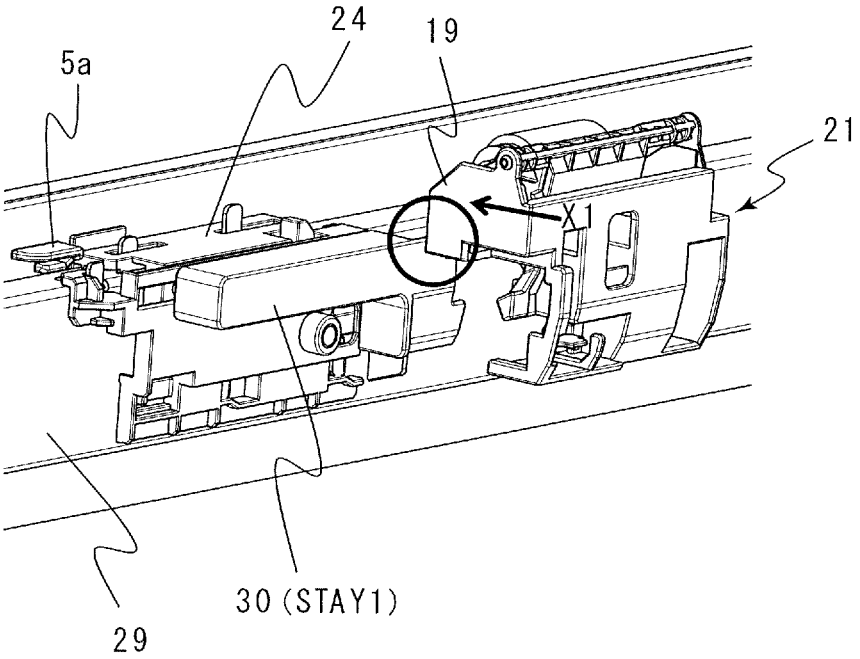
FIG. 17A is a perspective view illustrating a configuration of restricting the separation unit from being attached in the state in which the tray is inserted in the second embodiment.
Figure 17B:
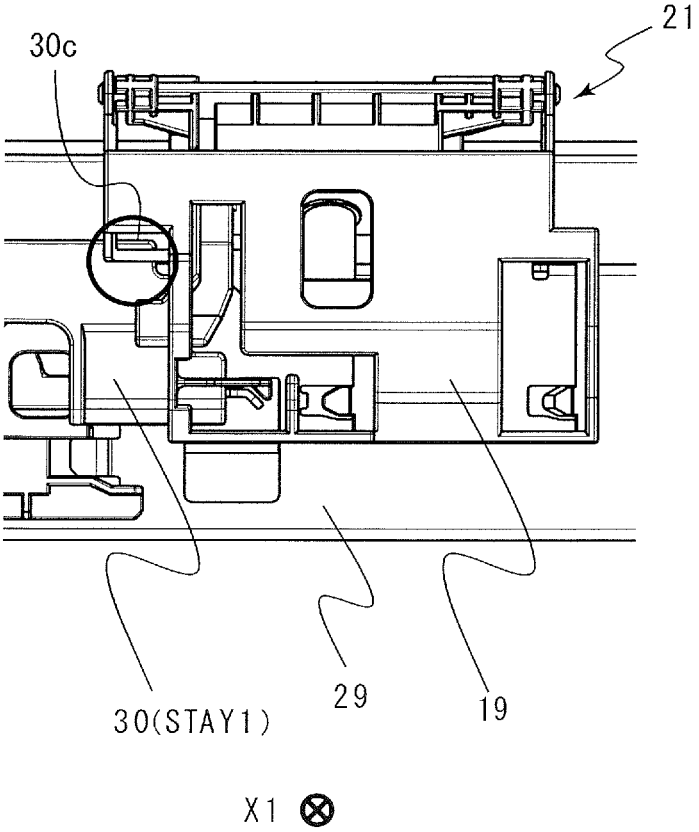
FIG. 17B is a side view of the configuration illustrated in FIG. 17A.
Figure 18A:
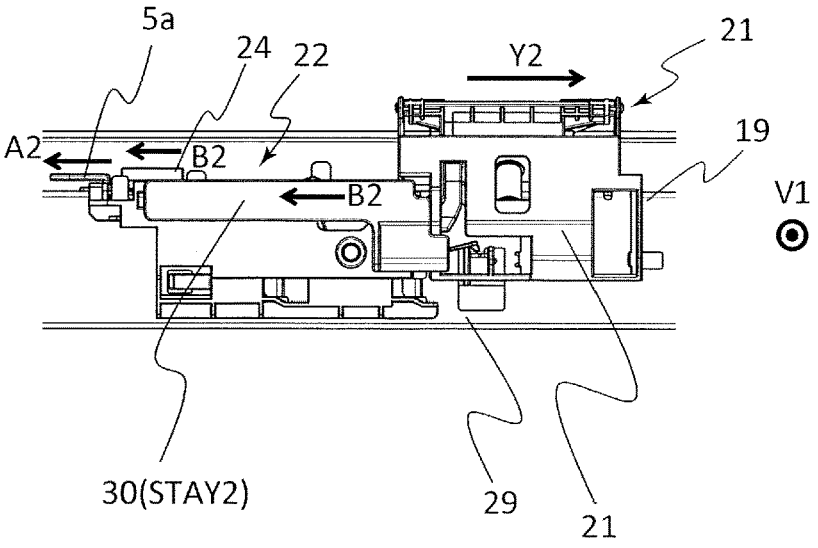
FIG. 18A is a side view illustrating a state in which detachment of the separation unit is permitted in the state in which the tray is drawn out in the second embodiment.
Figure 18B:
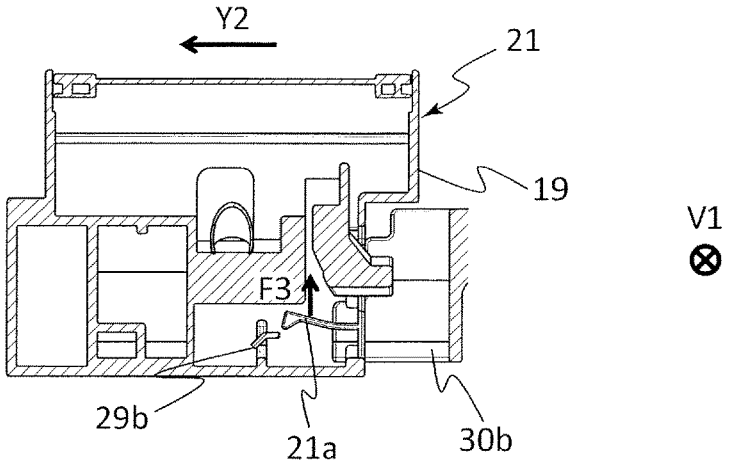
FIG. 18B is a section view illustrating the same state as FIG. 18A.
Figure 18C:
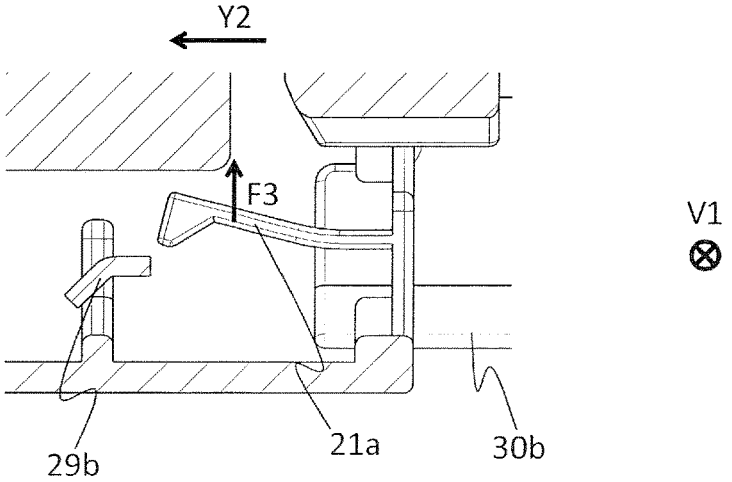
FIG. 18C is an enlarged section view illustrating the same state as FIGS. 18A and 18B.
Figure 19A:
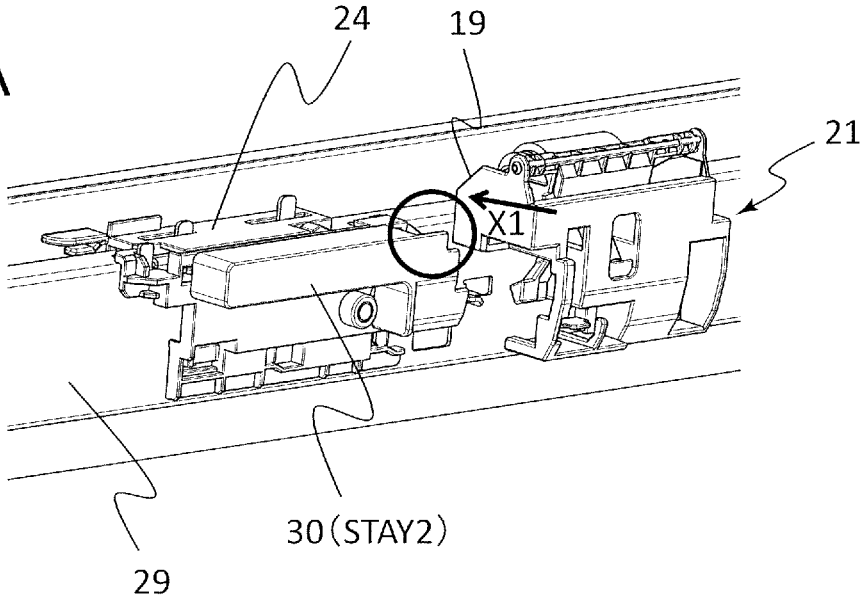
FIG. 19A is a side view illustrating a state in which attachment of the separation unit is permitted in the state in which the tray is drawn out in the second embodiment.
Figure 19B:
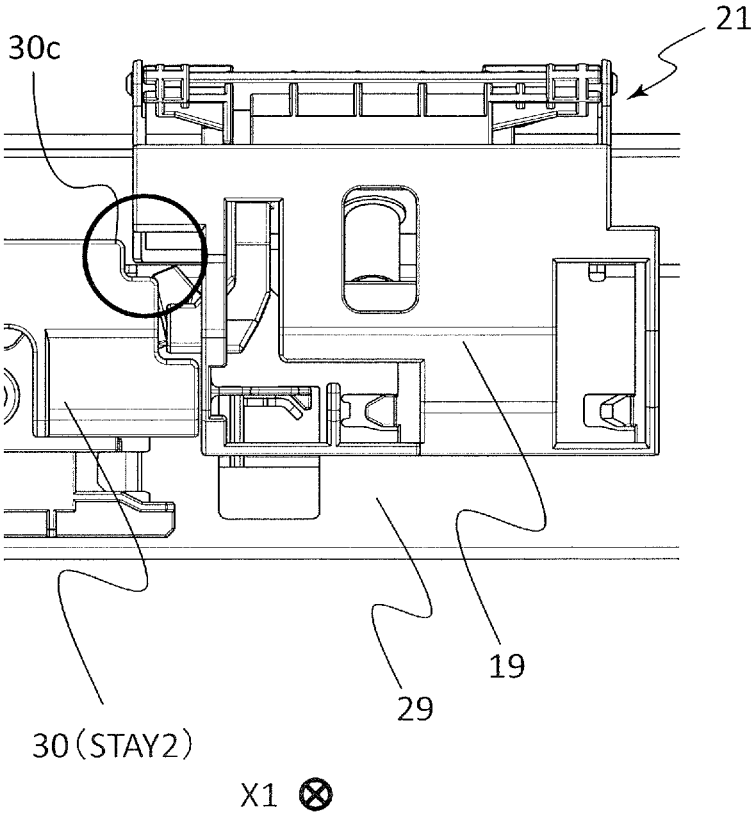
FIG. 19B is a side view illustrating the state.

An operation of the shutter member 30 will be described with reference to FIGS. 16A through 19B. Each drawing of FIGS. 16A through 16C and FIGS. 17A and 17B illustrates the state in which the sheet stacking tray 5 is inserted into the apparatus body. FIG. 16A is a side view illustrating the sheet feeding apparatus attached with the separation unit 21 seen from downstream in the sheet conveyance direction V1, FIG. 16B is a section view of the separation unit 21 seen from upstream in the sheet conveyance direction V1, and FIG. 16C is an enlarged section view of a main part of the separation unit 21. FIG. 17A is a perspective view illustrating an intermediate state of the operation of moving the separation unit 21 in the attachment direction X1 to attach to the holding plate 29, and FIG. 17B is a side view of the separation unit 21 seen from downstream in the attachment direction X1. Meanwhile, each drawing of FIGS. 18A through 18C and FIGS. 19A and 19B illustrates the state in which the sheet stacking tray 5 is drawn out of the apparatus body. FIG. 18A is a side view illustrating the sheet feeding apparatus, before the separation unit 21 is detached, seen from downstream in the sheet conveyance direction V1, FIG. 18B is a section view of the separation unit 21 seen from upstream in the sheet conveyance direction V1, and FIG. 18C is an enlarged section view illustrating a main part thereof. FIG. 19A is a perspective view illustrating an intermediate state of the operation of moving the separation unit 21 in the attachment direction X1 to attach to the holding plate 29, and FIG. 19B is a section view seen downstream in the attachment direction X1.

Tray Inserted State

When the sheet stacking tray 5 is inserted into the image forming apparatus in the insert direction A1, the shutter member 30 moves together with the disengagement slider 24 in the direction B1 along the tray insert direction A1 and stands by at the first standby position STAY-1 as illustrated in FIG. 16A. When the shutter member 30 is positioned at the first standby position STAY-1, a cover plate 30*b* provided on the shutter member 30 covers the slidability switching portion 21*a* seen from downstream in the sheet conveyance direction V1 as illustrated in FIGS. 16B and 16C. Because space for inserting a finger to press the slidability switching portion 21*a* is not assured in this state, the separation unit 21 cannot be slid in the direction Y2 and cannot be detached from the holding plate 29 by manipulating the slidability switching portion 21*a*. That is, the cover plate 30*b* of the shutter member 30 limits access to the switching portion by covering the slidability switching portion 21*a* (i.e., the switching portion) at least partially, and as a result functions as a first restriction portion that restricts the operation of detaching the separation unit 21.

Still further, when the separation unit 21 is moved in the attachment direction X1 to attach to the holding plate 29 in the state in which the shutter member 30 is positioned at the first standby position STAY-1 as illustrated in FIG. 17A, the separation base 19 is obstructed by the shutter member 30. In other words, the shutter member 30 is provided with a contact portion 30*c* overlapping with the separation base 19 in a view from the direction of attaching the separation unit 21 (i.e., in the direction X1) in the state in which the shutter member 30 is positioned at the first standby position STAY-1. Thereby, it is unable to move the separation unit 21 detached from the apparatus body in the direction X1 to attach to the holding plate 29 in the state in which the sheet stacking tray 5 is inserted into the apparatus body. That is, the contact portion 30*c* of the shutter member 30 functions as a second restriction portion to restrict the operation of attaching the separation unit 21 to the holding plate 29 by obstructing the separation unit 21 in the case of approaching the separation unit 21 toward an upstream side in the sheet conveyance direction to the apparatus body.

Thus, the shutter member 30 serving as the restriction portion in the present embodiment restricts the operation of attaching/detaching the separation unit 21 to/from the apparatus body in the state in which the shutter member 30 is positioned at the first standby position (i.e., in the first state). Therefore, no operation of attaching/detaching the separation unit 21 is performed in the state in which the sheet stacking tray 5 is inserted into the predetermined position (i.e., the first position) within the image forming apparatus (i.e., in the state in which the feed roller 7 is in contact with the separation roller 8). Then, it is possible to avoid a trouble such as damages on the surfaces of the rollers otherwise caused by sliding friction of the rollers in replacing the separation roller 8 similarly to the first embodiment.

Tray Drawn-Out State

Meanwhile, when the sheet stacking tray 5 is drawn out of the image forming apparatus in the draw-out direction A2, the shutter member 30 moves together with the disengagement slider 24 in the direction B2 and stands by at the second standby position STAY-2 as illustrated in FIG. 18A. When the shutter member 30 is positioned at the second standby position STAY-2, the shutter member 30 recedes from a vicinity of the slidability switching portion 21*a* to assure a space that enables to press the slidability switching portion 21*a* as illustrated in FIGS. 18B and 18C. In other words, the cover plate 30*b* of the shutter member 30 moves to a position where the slidability switching portion 21*a* is exposed in a view from downstream in the sheet conveyance direction V1. Thereby, performing the pressing operation on the slidability switching portion 21*a*, it is enabled to slide the separation unit 21 in the direction Y2 and to detach the separation unit 21 from the holding plate 29.

Still further, as illustrated in FIG. 19A, when the shutter member 30 is positioned at the second standby position STAY-2, the shutter member 30 recedes from a position where the shutter member 30 obstructs the separation unit 21 on a way of the attachment operation. In other words, the contact portion 30*c* of the shutter member 30 moves to a position where the contact portion 30*c* does not overlap with the separation unit 21 in a view from upstream in the attachment direction X1. It is possible to attach the separation unit 21 to the holding plate 29 by moving the separation base 19 in the attachment direction X1 to insert the claw portions 19*a* of the separation base 19 into the holes 29*a* of the holding plate 29 and to engage the claw portions 19*a* with the holes 29*a*.

Thus, in the state in which the shutter member 30 serving as the restriction portion is positioned at the second standby position (i.e., in the second state), the operation of attaching/detaching the separation unit 21 to/from the apparatus body is permitted. Due to that, it becomes possible to perform both operations of attaching/detaching the separation unit 21 to/from the holding plate 29 in the state in which the sheet stacking tray 5 is drawn out of the image forming apparatus and the feed roller 7 is disengaged from the separation roller 8.

Modified Examples

It is noted that while the shutter member 30 configured to cover the slidability switching portion 21*a* has been used in the present embodiment, another configuration by which an access to the separation unit 21 is limited in the state in which the sheet stacking tray 5 is inserted into the image forming apparatus may be adopted. For instance, the shutter member 30 may be formed into a shape that covers the entire separation unit 21 in the tray inserted state while omitting the slidability switching portion 21*a*. Still further, while the shutter member 30 has been configured to be linked with the operation of inserting/drawing the sheet stacking tray 5 into/out of the apparatus body through the disengagement slider 24, a configuration by which the shutter member 30 moves by being directly pressed by the sheet stacking tray 5 may be adopted. Still further, a configuration by which a part of the sheet stacking tray 5 directly covers the slidability switching portion 21*a* in the tray inserted state may be also adopted.

Other Embodiments

While the technology of the present disclosure is applied to the sheet feeding apparatus that feeds a sheet to the image forming portion in the first and second embodiments described above, this technology is also applicable to a sheet feeding apparatus that feeds a sheet to another part. For instance, the sheet feeding apparatus may be used as a document feeding apparatus, provided in an image reading apparatus such as a scanner, which feeds a sheet as an original document to an image reading portion configured to optically scan the sheet to read an image. Besides the apparatus body in which the image forming portion is mounted, the image forming apparatus is often attached with a large-volume feeding apparatus, i.e., an option feeder, configured to feed a sheet to the apparatus body or with a sheet processing apparatus that binds sheets discharged out of the apparatus body while attaching a cover and an interleaf. The technology of the present disclosure may be used also as a sheet feeding apparatus of such attachment device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-177086, filed on Sep. 14, 2017, which is hereby incorporated by reference herein in its entirety.

What is claimed is:

1. A sheet feeding apparatus comprising:

an apparatus body;

a sheet stacking portion on which sheets are stacked and which is configured to be inserted into and drawn out of the apparatus body;

a conveyance member configured to convey a sheet stacked on the sheet stacking portion in a sheet conveyance direction;

a separating roller configured to be in contact with the conveyance member and to separate the sheet conveyed by the conveyance member from another sheet;

a disengaging mechanism configured to disengage the conveyance member and the separating roller to be apart from each other;

a unit attached to the apparatus body and configured to be detached from the apparatus body toward a downstream side in the sheet conveyance direction, wherein the unit comprises a roller holder configured to hold the separating roller and a separating spring urging the roller holder toward the conveyance member to bring the separating roller into pressure-contact with the conveyance member; and a restriction portion configured to restrict the unit from being detached from the apparatus body in a state where the conveyance member and the separating roller are in contact with each other and to permit the unit to be detached from the apparatus body in a state where the conveyance member and the separating roller are disengaged by the disengaging mechanism, wherein the disengaging mechanism is configured to disengage the separating roller from the conveyance member by moving into contact with the roller holder and moving the roller holder against an urging force of the separating spring in response to the sheet stacking portion being drawn out.

2. The sheet feeding apparatus according to claim 1, wherein the sheet stacking portion is provided to be drawn out of the apparatus body from an attachment position where the sheet stacking portion is inserted in the apparatus body, wherein the disengaging mechanism is configured to bring the conveyance member and the separating roller into contact with each other in a case where the sheet stacking portion is positioned at the attachment position and to disengage the conveyance member and the separating roller in a case where the sheet stacking portion is moved away from the attachment position, and wherein the restriction portion is further configured to restrict the unit from being attached to and detached from the apparatus body in a case where the sheet stacking portion is positioned at the attachment position and to permit the unit to be attached to and detached from the apparatus body in a case where the sheet stacking portion is moved away from the attachment position such that the conveyance member and the separating roller are disengaged by the disengaging mechanism.

3. The sheet feeding apparatus according to claim 1, wherein the restriction portion is provided on a component of the disengaging mechanism.

4. The sheet feeding apparatus according to claim 2, wherein the restriction portion comprises a first restriction portion configured to restrict the unit that is attached to the apparatus body from being detached from the apparatus body and a second restriction portion configured to restrict the unit that is not attached to the apparatus body from being attached to the apparatus body.

5. The sheet feeding apparatus according to claim 4, wherein both of the first and second restriction portions are provided in a single member.

6. The sheet feeding apparatus according to claim 2, wherein the restriction portion is located at a position obstructing a moving locus of the unit in attaching and detaching the unit with respect to the apparatus body in a case where the conveyance member and the separating roller are in contact with each other and is moved away from the moving locus in a case where the conveyance member and the separating roller are disengaged by the disengaging mechanism.

7. The sheet feeding apparatus according to claim 6, wherein the unit comprises an engagement claw configured to engage with an engagement portion provided in the apparatus body and to be disengaged from the engagement portion by being moved in a direction intersecting the sheet conveyance direction, and wherein the restriction portion is configured to restrict the unit from moving in the direction intersecting the sheet conveyance direction in a case where the unit is attached to the apparatus body with the conveyance member and the separating roller in contact with each other.

8. The sheet feeding apparatus according to claim 1, wherein the unit comprises a switching portion configured to be operated to a position where the unit is restricted from being detached from the apparatus body and to a position where restriction on detaching the unit is released, and wherein the restriction portion is located at a position where the restriction portion covers the switching portion such that the switching portion is not operated from the downstream side in the sheet conveyance direction in a case where the unit is attached to the apparatus body with the conveyance member and the separating roller in contact with each other, and is configured to be located at a position where the switching portion can be operated from the downstream side in the sheet conveyance direction in a case where the conveyance member and the separating roller are disengaged by the disengaging mechanism.

9. The sheet feeding apparatus according to claim 8, wherein the switching portion is an elastic member arranged in contact with the apparatus body and configured to be operated such that the switching portion deforms elastically so as not to be in contact with the apparatus body.

10. The sheet feeding apparatus according to claim 1, wherein the disengaging mechanism comprises a first movable member configured to move with respect to the apparatus body along with insertion and draw-out of the sheet stacking portion with respect to the apparatus body and a second movable member configured to be moved by the first movable member so as to move either one of the conveyance member and the separating roller relative to the other.

11. The sheet feeding apparatus according to claim 10, wherein the sheet stacking portion is movable along a sheet width direction orthogonal to the sheet conveyance direction, and wherein the first and second movable members are configured to convert a direction of a force received from the sheet stacking portion so as to engage and disengage the conveyance member and the separating roller.

12. The sheet feeding apparatus according to claim 11, wherein the first movable member is a slide member configured to slide being pressed by the sheet stacking portion, wherein the second movable member is a turning member configured to turn being pressed by the slide member, and wherein a force that makes the slide member slide is converted into a force that turns the turning member.

13. The sheet feeding apparatus according to claim 1, wherein the unit comprises the roller holder configured to hold the separating roller and to be moved by the disengaging mechanism between a position where the separating member comes into contact with the conveyance member and a position where the separating roller is disengaged from the conveyance member, and a base member configured to movably support the roller holder and to be attached to the apparatus body.

14. The sheet feeding apparatus according to claim 1, wherein both the conveyance member and the separating roller are rollers, and wherein a rotation axis of a roller provided in the unit among the conveyance member and the separating roller is positioned downstream of a rotation axis of a roller provided in the apparatus body among the conveyance member and the separating roller in a direction in which the unit is detached from the apparatus body.

15. The sheet feeding apparatus according to claim 1, further comprising an openable member openable toward the downstream side in the sheet conveyance direction of the separating roller with respect to the apparatus body, wherein the unit is taken out of the apparatus body with the openable member open.

16. An image forming apparatus comprising:

a sheet feeding apparatus as set forth in claim 1, and an image forming portion configured to form an image on a sheet fed from the sheet feeding apparatus.

17. A sheet feeding apparatus comprising:

an apparatus body;

a sheet stacking portion on which sheets are stacked and which is configured to be inserted into and drawn out of the apparatus body;

a conveyance member configured to convey a sheet stacked on the sheet stacking portion in a sheet conveyance direction;

a separating member configured to be in contact with the conveyance member and to separate the sheet conveyed by the conveyance member from another sheet;

a disengaging mechanism configured to disengage the conveyance member and the separating member to be apart from each other;

a unit attached to the apparatus body and configured to be detached from the apparatus body toward a downstream side in the sheet conveyance direction, wherein the separating member is provided in a holding member rotatably supported on the unit and the conveyance member is provided in the apparatus body; and a restriction portion configured to restrict the unit from being detached from the apparatus body in a state where the conveyance member and the separating member are in contact with each other and to permit the unit to be detached from the apparatus body in a direction substantially perpendicular to the sheet conveyance direction in a state where the conveyance member and the separating member are disengaged by the disengaging mechanism wherein the disengaging mechanism is configured to disengage the separating member from the conveyance member by moving into contact with the holding member and rotating the holding member and the separating member away from the conveyance member in response to the sheet stacking portion being drawn out of the apparatus body.

* * * * *